US008139971B2

(12) United States Patent
Yamamoto

(10) Patent No.: US 8,139,971 B2
(45) Date of Patent: Mar. 20, 2012

(54) IMAGE HEATING APPARATUS OPERABLE IN STAND-BY-MODE

(75) Inventor: Naoyuki Yamamoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 367 days.

(21) Appl. No.: 12/398,231

(22) Filed: Mar. 5, 2009

(65) Prior Publication Data

US 2009/0252509 A1 Oct. 8, 2009

(30) Foreign Application Priority Data

Mar. 5, 2008 (JP) ..... 2008-054611

(51) Int. Cl.
*G03G 15/20* (2006.01)

(52) U.S. Cl. ..... 399/70; 219/216; 219/619

(58) Field of Classification Search ..... 399/69, 399/70; 219/216, 619; 347/156
See application file for complete search history.

(56) References Cited

U.S. PATENT DOCUMENTS

2005/0173415 A1* 8/2005 Yamamoto et al. ..... 219/619
2006/0088324 A1* 4/2006 Fujimoto et al. ..... 399/33
2006/0157475 A1* 7/2006 Nishihara et al. ..... 219/619
2007/0212091 A1* 9/2007 Kinouchi et al. ..... 399/69

FOREIGN PATENT DOCUMENTS

JP 9-281821 10/1997
JP 2000-39797 2/2000

* cited by examiner

*Primary Examiner* — Sophia S Chen
(74) *Attorney, Agent, or Firm* — Fitzpatrick, Cella, Harper & Scinto

(57) ABSTRACT

An image heating apparatus has a coil; a rotatable image heating member capable of generating heat by a magnetic flux generated by the coil to heat an image; a temperature detecting member; an electric power supply controller for controlling electric power supply to the coil; and an execution portion for executing a stand-by mode operation in which the image heating member is at rest, and the apparatus waits for input of an image formation signal while the electric power supply controller carries out its power supply control operation such that in the stand-by mode, along no longitudinal line on said image heating member, the temperature of the image heating member exceeds Curie temperature on an entirety of the longitudinal line.

24 Claims, 14 Drawing Sheets

(a) WINDING DIRECTION PARALLEL TO ROTATIONAL AXIS (b) WINDING DIRECTION PERPENDICULAR TO ROTATIONAL AXIS

IMAGE HEATING APPARATUS OPERABLE IN STAND-BY-MODE

FIELD OF THE INVENTION AND RELATED ART

The present invention relates to an image forming apparatus represented by a copying machine, a printer, a facsimile machine, an apparatus made up of a combination of the preceding apparatuses, etc., which uses an electrophotographic process, an electrostatic recording process, or the like process. More specifically, it relates to an image heating apparatus employed by an image forming apparatus to heat images on recording medium by an inductive heating method, that is, a method which heats the images with the use of the heat generated by the electric current induced by a magnetic flux.

An electrophotographic image forming apparatus is provided with an image heating apparatus, which is for fixing an unfixed toner image formed on a sheet of recording medium (which also is object to be heated), to the surface of the sheet of recording medium, with the use of heat.

Generally, an image heating apparatus has: an image heating member which melts the toner on a sheet of recording medium with use of heat; and a pressing means which keeps a sheet of recording medium pressed between itself and image heating member, by being kept pressed upon the image heating member.

An image heating member is in the form of a roller (heat roller) or an endless belt, for example. It is directly or indirectly heated by a heat generating member. Further, it is internally or externally heated. As the heating devices usable as an image heating member, a halogen heater, a heat generating resistor, etc., can be listed, for example.

It has been thought to be very important, in particular, in recent years, to reduce an image forming apparatus in energy consumption, and also, to improve an image forming apparatus in operability (fast printing, short warm-up time). Thus, it has been proposed to employ an image heating apparatus which is significantly higher in heat generation efficiency than any of the conventional image heating apparatuses which have been employed as the image heating apparatus for an image forming apparatus. One of such image heating apparatuses is an image heating apparatus which employs a heating method based on magnetic induction, which is very high in heat generation efficiency (this type of image heating apparatus hereafter will be referred to as inductive heating apparatus).

An inductive heating apparatus directly heats its image heating member. It has a coil (exciter coil) for generating a magnetic field. In operation, high frequency current is flowed through the coil (exciter coil). As the current is flowed, current (eddy current) is induced in the image heating member by the magnetic field generated by the coil. As a result, heat (Joule heat) is generated in the image heating member by the interaction between the skin resistance of the image heating member and the eddy current. An inductive heating apparatus is significantly higher in heat generation efficiency than any of the conventional heat generating apparatuses. Thus, employment of an inductive heating apparatus can significantly reduce the time it takes for an image heating apparatus to warm up.

The attitudes of the induction coil in an inductive heating apparatus can be roughly divided into those representable by the attitude in which a coil 6 is in FIG. 13(*a*), and those representable by the attitude in which the coil 6 is in FIG. 13(*b*).

In FIG. 13(*a*), the coil 6 is in such an attitude that the direction in which the coil 6 (wire) is wound is perpendicular to the rotational axis of the image heating member 1. Thus, the magnetic flux which the coil 6 generates is perpendicular to the rotational axis of the heating member 1 (rotational member).

In FIG. 13(*b*), the coil 6 is in such an attitude that the direction in which the coil 6 is wound is parallel to the rotational axis of the image heating member 1. Thus, the magnetic flux which the coil 6 generates is parallel to the rotational axis of the heating member 1 (rotational member).

However, in the case of the attitude in which the coil 6 is in FIG. 13(*a*), the magnetic flux which the coil 6 generates leaks outward at the lengthwise ends of the image heating member 1, and therefore, it is possible that the components in the adjacencies of the lengthwise ends of the image heating member will also be heated. Thus, in order to prevent the magnetic flux from leaking from the lengthwise ends of the image heating member, a member for blocking the magnetic flux needs to be placed at the lengthwise ends of the image heating member 1. Further, in order to heat the entirety of the image heating member 1 in terms of the direction parallel to its axial line, the coil 6 must be substantial in the number of turns, and therefore, will be substantial in the amount by which current has to be flowed to warm up the image heating member 1. In order to flow current by a larger amount through the coil 6, it is necessary to employ a larger high frequency power source, which is higher in cost. Thus, disposing the coil 6 in the attitude shown in FIG. 13(*a*) is problematic in terms of cost.

Based on the reasons given above, it may be said that disposing the coil 6 in the attitude shown in FIG. 13(*b*) is advantageous over disposing the coil 6 in the attitude shown in FIG. 13(*a*). One of the image heating apparatuses in which the coil 6 is disposed as shown in FIG. 13(*b*) is disclosed in Japanese Laid-open Patent Application H09-281821.

One of the effective methods for reducing an image forming apparatus in energy consumption and warm-up time is to reduce the image heating member of the image forming apparatus in thermal capacity. However, if small sheets of recording medium are continuously passed through an image forming apparatus whose image heating member is small in thermal capacity, the portions of the image heating member, which are outside the path of the small recording sheets, increase in temperature (out-of-sheet-path temperature increase). One of the measures for preventing this phenomenon is disclosed in Japanese Laid-open Patent Application 2000-39797, which proposes to employ an inductive heating apparatus whose heating member is made of a magnetic alloy which has been designed so that its Curie point becomes the same as the fixation temperature point of the inductive heating apparatus.

Generally, as a magnetic substance is heated to a temperature level higher than its specific Curie point, it becomes nonmagnetic (it fails to magnetize itself), reducing therefore in skin resistance. Thus, as a magnetic substance is heated to a temperature level higher than its specific Curie point, it reduces in the amount of heat it generates. Therefore, a heat roller made of a magnetic alloy whose Curie point has been set to a specific value becomes stable in temperature at a saturation point which is determined by the relationship between the amount by which heat radiates from the heat roller and the amount of heat which the heat roller generates when its temperature is no less than its Curie point. This phenomenon can be used to prevent the abovementioned out-of-sheet-path portion of the heat roller from excessively increasing in temperature.

In order to control the temperature of the image heating member, the temperature of the image heating member is detected by a temperature detecting member. Thus, unless the temperature detecting member is properly positioned relative to the image heating member, it is possible that as a preset voltage is applied to flow high frequency current through the coil, the temperature of some portions of the image heating member will increases beyond The Curie point of the image heating member. More specifically, in a case where an image heating apparatus is structured so that the amount by which electric power is flowed through the coil is controlled based on the temperature of the image heating member detected by a temperature detecting member positioned so that it detects the temperature of a portion of the image heating member, which is smaller in the amount of heat generated therein by the magnetic flux, the portions of the heating member, which are greater in the amount of heat generation than the portion of the heating member, the temperature of which is detected, becomes excessive in the amount of heat. This phenomenon is likely to occur when the image heating member is controlled in temperature while the image heating member is stationary, or is kept on standby, that is, when the heating member is rotated at a slow speed, and therefore, the heating member is in the condition in which it is unlikely to become uniform in temperature. As a part of an image heating member formed of a magnetic alloy of which the Curie point has been set to a specific value exceeds in temperature the specific value, the coil which generates the magnetic field, to which the image heating member is subjected, suddenly reduces in load resistance. As a result, the amount by which current flows through the coil increases (excessive amount of current). In other words, the image heating member is heated by the greater amount of current than the target amount for the current control.

As this excessive amount of current continuously flows in the image heating member, the temperature of more portions of the image heating member exceeds The Curie point, which in turn causes even more portions of the image heating member to exceed in temperature The Curie point, exacerbating the undesirable condition. Thus, if this condition continues, the high frequency power source for flowing high frequency current through the exciter coil excessively increase in temperature, breaking sometimes.

That is, if the temperature of an image heating member made up of a magnetic alloy exceeds The Curie point, the coil suddenly reduces in impedance, which in turn allows the amount by which current flows through the coil, to increase. This phenomenon occurs even if it is the temperature of only a part of the image heating member, in terms of its circumferential direction, that exceeds The Curie point. It occurs because the high frequency power source is not controlled in response to the change in the impedance of the coil. In a case where the table used for controlling the high frequency power source is fixed, the amount by which current flows through the coil changes (increases) as the impedance of the coil changes (reduces). As a result, the number and/or size of the areas of the image heating member, the temperature of which is higher than The Curie point increases, which in turn increases the speed at which the current increases, eventually destroying the power source.

On the other hand, in the case of the coil disposed in the attitude shown in FIG. 13(*b*), the above described condition, that is, the condition in which an excessive amount of current flows through the coil, more conspicuously occurs, in particular, if the temperature of the image heating member exceeds The Curie point across roughly the entirety of the image heating member in terms of the circumferential direction of the image heating member.

The phenomenon that a certain portion, or portions, of the Curie roller in terms of its circumferential direction becomes higher in temperature than the Curie point Tc across the entirety of the roller in terms of the direction parallel to its rotational axis is such a phenomenon that conspicuously occurs in a case where the Curie roller is controlled in temperature while it is kept stationary. Even in a case where the Curie roller is rotated, it still occurs if the speed at which the roller is rotated is slow, that is, the speed at which the roller is rotated is not fast enough to be effective to make the roller uniform in temperature across its entirety in terms of its circumferential direction. In other words, unless the speed at which the Curie roller is rotated is fast enough to be effective to make the roller uniform in temperature in terms of its circumferential direction, it cannot be avoided that a portion or portions of the Curie roller in terms of its circumferential direction exceeds the Curie point Tc across the entirety of the roller in terms of the direction parallel to its rotational axis.

SUMMARY OF THE INVENTION

The primary object of the present invention is to provide an image heating apparatus, the image heating member of which is made up of a substance adjusted in Curie point, and which is significantly less in the load on its high frequency power source than a conventional image heating apparatus.

According to an aspect of the present invention, there is provided an image heating apparatus comprising a coil; a rotatable image heating member capable of generating heat by a magnetic flux generated by said coil to heat an image; a temperature detecting member for detecting a temperature of said image heating member; electric power supply control means for controlling electric power supply to said coil in accordance with an output of said temperature detecting member; and an execution portion for executing a stand-by mode operation in which said image heating member is at rest, and said apparatus waits for input of an image formation signal while said electric power supply control means carries out its power supply control operation such that temperature of a part of said image heating member which is detected by said temperature detecting member is at a predetermined stand-by temperature, wherein in the stand-by mode, along no longitudinal line on said image heating member, the temperature of said image heating member exceeds Curie temperature on an entirety of the longitudinal line.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings.

Embodiment 1

(1) Example of Image Forming Apparatus

Figure 1:
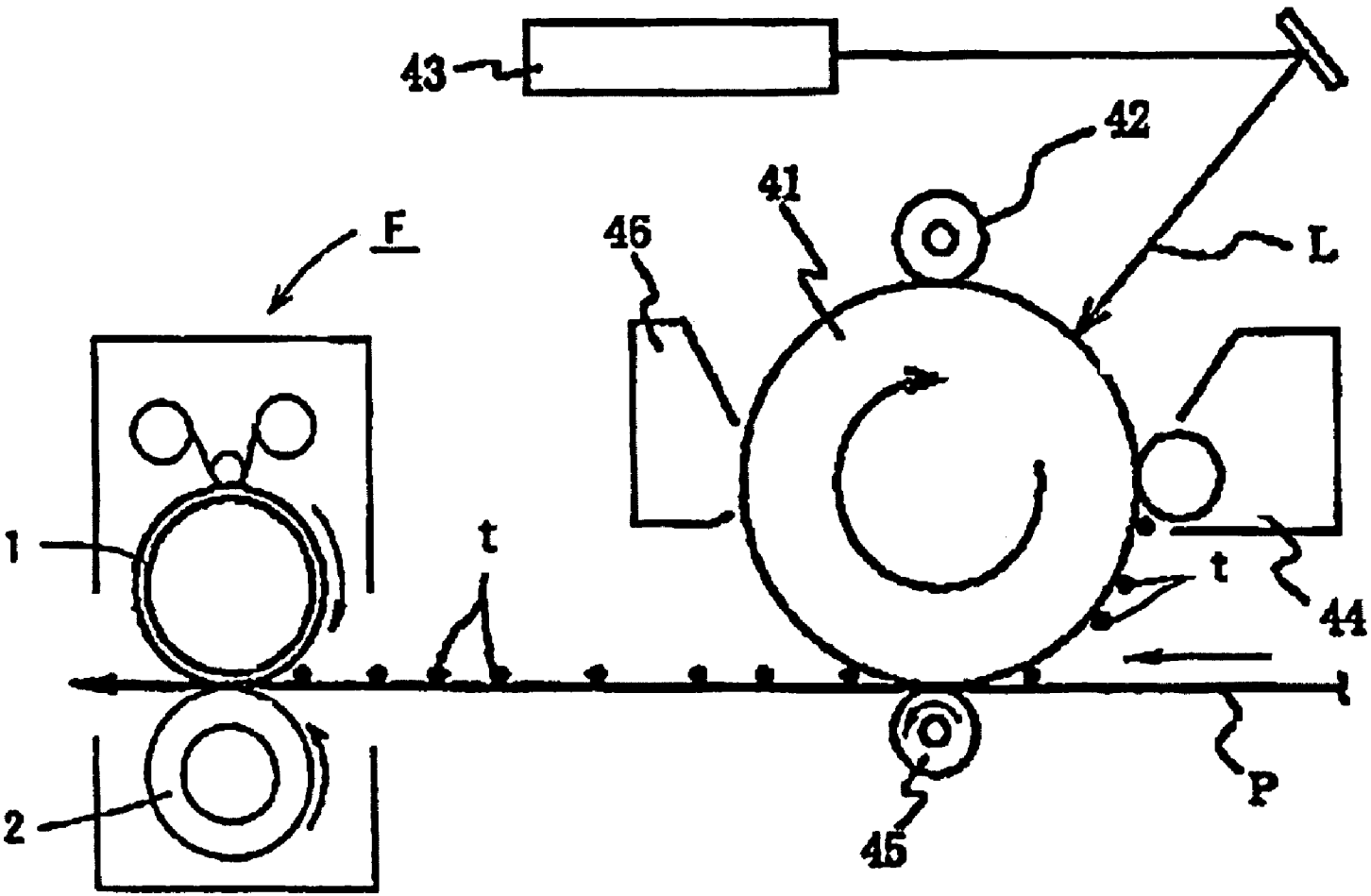
FIG. 1 is a schematic sectional view of the image forming apparatus in the first preferred embodiment of the present invention, showing the general structure thereof.

FIG. 1 is a schematic sectional view of an example of an image forming apparatus, the fixing apparatus of which is an image heating apparatus which uses the inductive heating method in accordance with the present invention.

This image forming apparatus is a digital image forming apparatus (copying machine, printer, facsimile machine, machine having functions of two or more of preceding apparatuses, etc.) which uses an electrophotographic process.

Designated by a referential number 41 is the image bearing member of the image forming apparatus. The image bearing member 41 is a rotational photosensitive member which is in the form of a drum (which hereafter will be referred to as photosensitive drum). It is rotationally driven in the clockwise direction, indicated by an arrow mark in the drawing, at a preset peripheral velocity.

Designated by a referential number 42 is a primary charging device, which negatively and uniformly charges the photosensitive drum 41 to a preset potential level Vd (dark potential level).

Designated by a referential number 43 is an exposing means, which in this embodiment is a laser beam scanner. The exposing means 43 outputs a beam of laser light L in such a manner that the beam scans the uniformly charged portion of the photosensitive drum 41, while modulating the beam with the digital image formation signals inputted from a host apparatus (unshown), such as an image reading apparatus, a computer, etc. As a result, the exposed points of the uniformly charged portion of the peripheral surface of the photosensitive drum 41 reduces in potential (in terms of absolute value) to a light potential level V1, effecting thereby an electrostatic latent image, which reflects the image formation signals, on the peripheral surface of the photosensitive drum 41. The electrostatic latent image is developed by a developing device 44 into a visible image t formed of toner (which hereafter will be referred to as toner image t). In the case of the image forming apparatus in embodiment, negatively charged toner adheres to the points of the uniformly charged portion of the peripheral surface of the photosensitive drum 41, which have been reduced in potential to the light potential level V1 by the exposure. That is, the electrostatic latent image is developed in reverse into the toner image.

Meanwhile, the sheets P of recording medium, such as paper, are fed into the main assembly of the image forming apparatus, and then, are delivered to the transfer portion, which is the interface between a transfer roller 45 (as an image transferring member), and the photosensitive drum 41, with a proper timing, while a transfer bias is applied to the transfer roller 45. Then, as the sheet P of recording medium (which hereafter will be referred to simply as recording sheet P) is conveyed through the interface, the toner image t on the peripheral surface of the photosensitive drum 41 is electrostatically transferred onto the recording sheet P in a manner of being peeled away from the photosensitive drum 41.

After the transfer of the toner image t onto the recording sheet P, the recording sheet P is separated from the photosensitive drum 41. Then, it is introduced into a fixing apparatus F, and conveyed through the fixation nip N, which is the interface between the heat roller 1 and pressure roller 2 of the fixing apparatus F, while remaining pinched by the two rollers 1 and 2. While the recording sheet P is conveyed through the fixation nip N, the toner image t on the recording sheet P is fixed to the surface of the recording sheet P by the heat and pressure applied by the two rollers 1 and 2. Thereafter, the recording sheet P is discharged from the image forming apparatus.

After the separation of the recording sheet P from the photosensitive drum 41, the peripheral surface of the photosensitive drum 41 is cleaned by a cleaning apparatus 46; the transfer residual toner, that is, the toner remaining on the peripheral surface of the photosensitive drum 41, is removed by the cleaning apparatus 46. Then, the photosensitive drum 41 is used for the next cycle of image formation.

(2) Fixing Apparatus F

Figure 2:
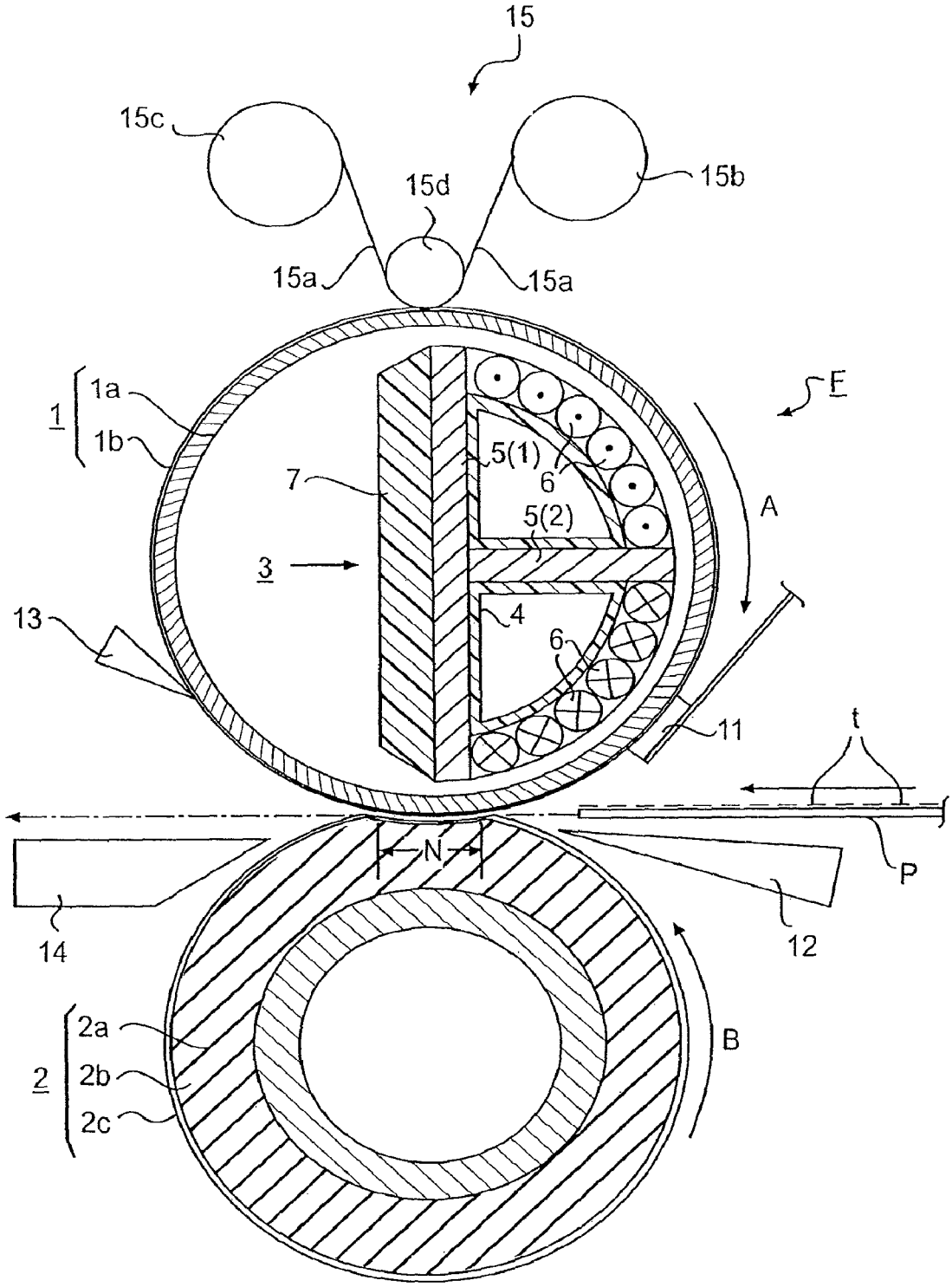
FIG. 2 is an enlarged sectional view of the essential portions of the fixing apparatus (inductive heating apparatus) in the first preferred embodiment.
Figure 3:
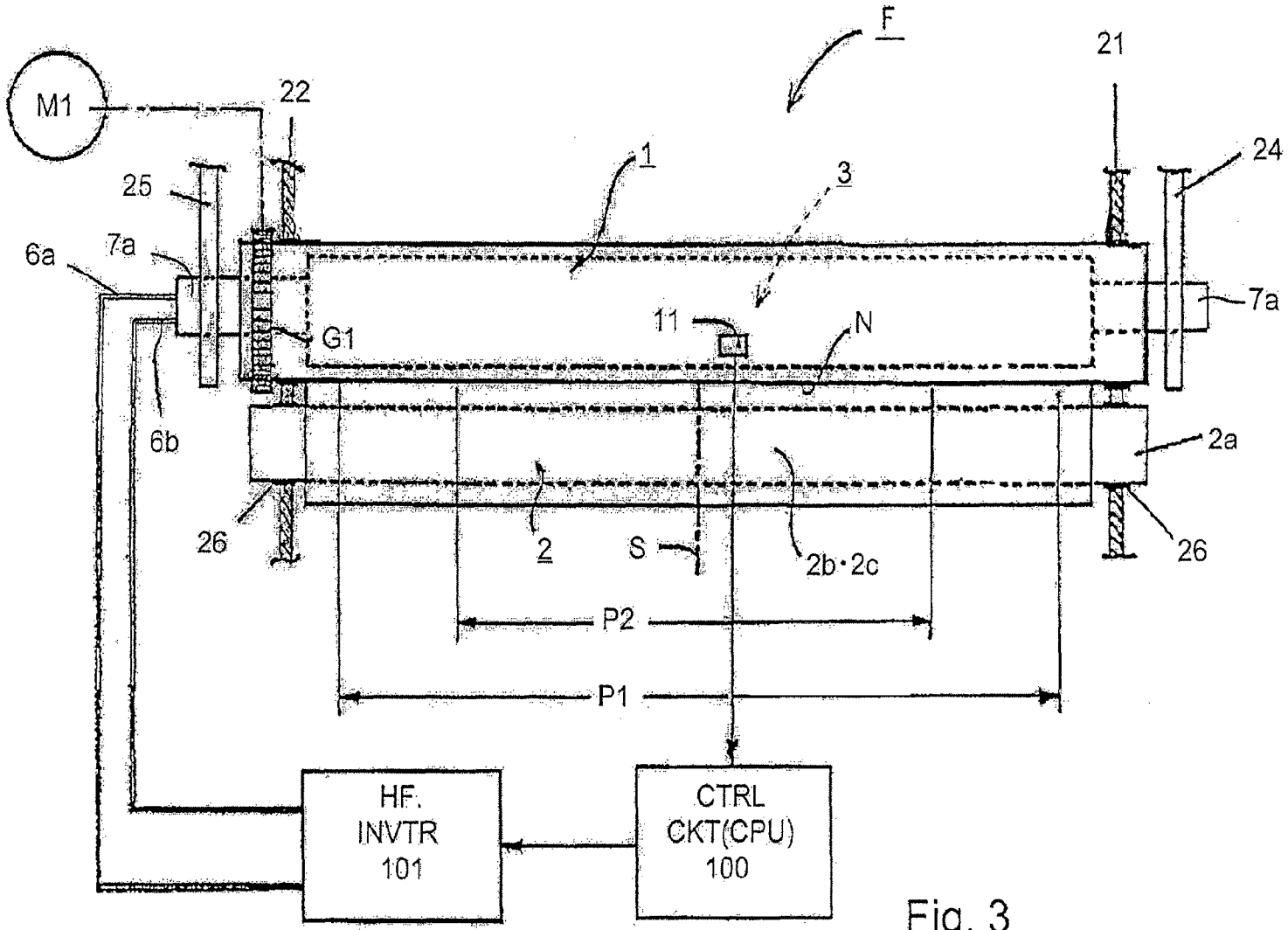
FIG. 3 is a schematic front plan view of the essential portions of the fixing apparatus shown in FIG. 2.
Figure 4:
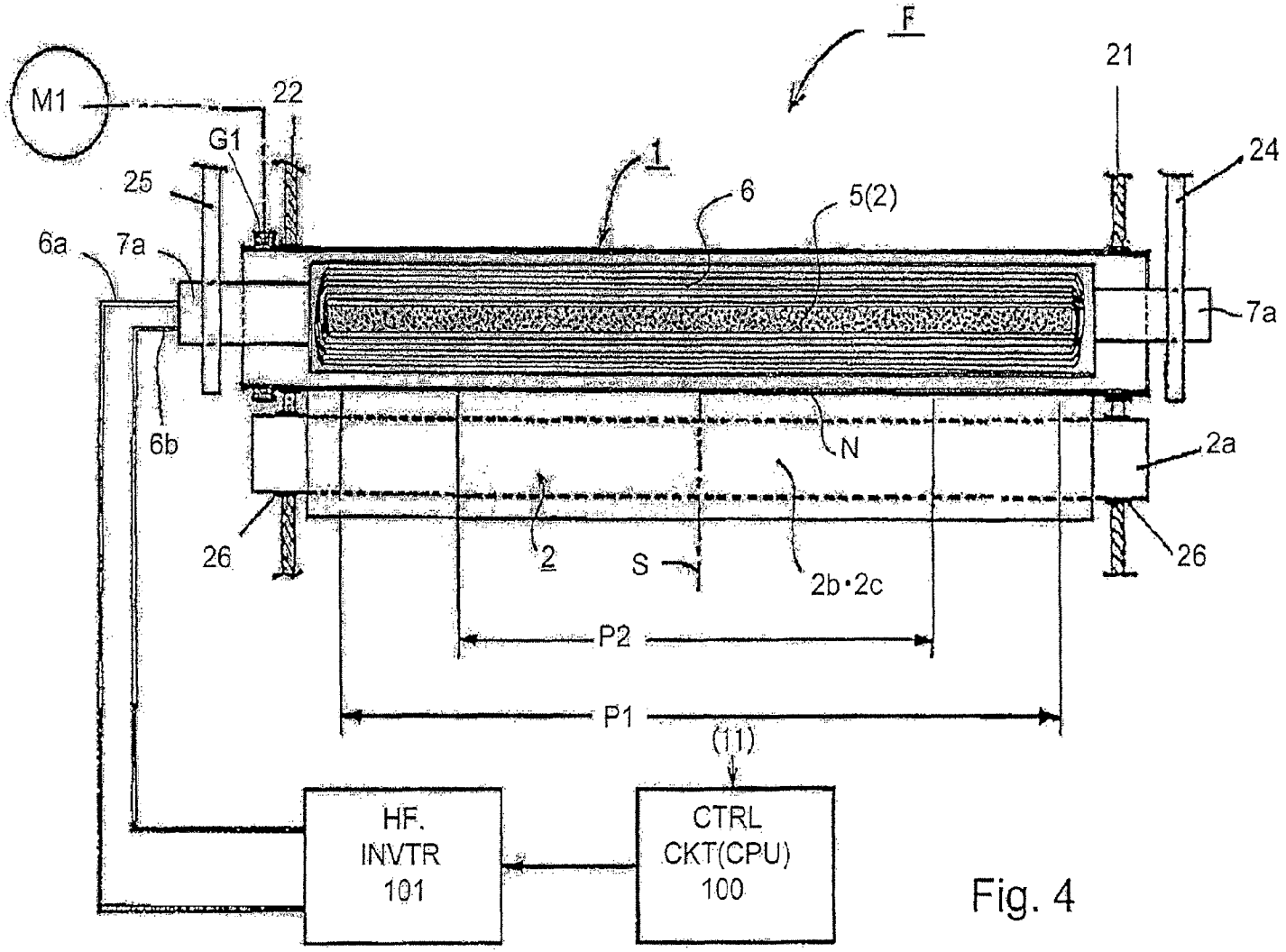
FIG. 4 is a schematic vertical sectional view of the essential portions of the fixing apparatus shown in FIG. 2, at the plane which coincides with the axial line of the heating member of the fixing apparatus.

FIG. 2 is an enlarged sectional view of the essential portions of the fixing apparatus F. FIG. 3 is a schematic frontal plan view of the essential portions of the fixing apparatus F. FIG. 4 is a schematic vertical sectional view of the essential portions of the fixing apparatus F, at the vertical plane which coincides with the axial line of the heating member of the fixing apparatus F. Here, the front side of the fixing apparatus F is the side which has the recording sheet entrance.

This fixing apparatus F is an image heating apparatus which employs a heat roller in which heat is generated by magnetic induction. It has a pressure roller 2 in addition to the heat roller (fixation roller). The heat roller 1 is an image heating member. It has an electrically conductive layer in which heat is generated by a magnetic flux. The pressure roller 2 is a member for pressing the recording sheet P upon the heat roller 1. It is kept pressed upon the heat roller 1, forming the nip N, through which the recording sheet P is conveyed while remaining pinched by the two rollers 1 and 2.

The heat roller 1 (as an image heating member), is a Curie roller made of a magnetic alloy. More specifically, at least a part of the heat roller 1 is made of a magnetic alloy, the Curie point Tc of which has a specific value. The heat roller 1 is 40 mm in external diameter, 0.8 mm in thickness, and 340 mm in length. It has a metallic core 1*a*, which is the electrically conductive layer. The metallic core 1*a* in this embodiment is formed of a magnetic alloy which is made of iron, nickel, chromium, etc., and the Curie point Tc of which is 210°C.

The Curie point Tc is set to a value which is greater than that of the image heating temperature Tf (which hereafter will be referred to as fixation temperature Tf, and is 200° in this embodiment), that is, the target temperature value (operational temperature value for heating recording sheet) for heating the image on the recording sheet P when forming an image. Further, the Curie point Tc is set to a value no greater than the value of the highest temperature (which in this embodiment is 230° C.) which the image heating apparatus can withstand. That is, the target temperature of the heat roller 1 is set to a value no greater than the Curie point Tc. Incidentally, the highest temperature which the image heating apparatus can withstand means the temperature level, beyond which some of the components of the image heating apparatus excessively wear because of heat.

The peripheral surface of the metallic core 1*a* is covered with a surface layer 1*b*, which is formed of fluorinated resin, such as PFA, PTFE, etc., in order to ensure that the toner separates from the heat roller 1. The surface layer 1*b* is 30 μm in thickness. Incidentally, in order to ensure that a high quality image, such as a color image, is satisfactorily fixed, the heat roller 1 may be provided with a heat resistant elastic layer, which is placed between the metallic core 1*a* and surface layer 1*b*.

The heat roller 1 is rotatably supported by the front and rear plates 21 and 22 (parts of fixation unit frame), which are parts of the fixing apparatus F. More specifically, the front and rear lengthwise end portions of the heat roller 1 are supported by a pair of bearings attached to the front and rear plates 21 and 22, respectively. Further, the heat roller 1 is provided with a coil assembly 3, which is a means for generating a magnetic field. The coil assembly 3 has an exciter coil for generating a high frequency magnetic field. The coil assembly 3 is disposed in the hollow of the heat roller 1 to generate a high frequency magnetic field, which is for inducing electric current in the abovementioned metallic core 1*a* of the heat roller 1 to generate heat (Joule heat) in the metallic core 1*a*.

The pressure roller 2 is 38 mm in external diameter, 330 mm in length. It has a metallic core 2*a*, which is 28 mm in external diameter, and 3 mm in thickness. It has also a heat resistant elastic layer 2*b* and a surface layer 2*c*. The heat resistant elastic layer 2*b* is 5 mm in thickness, and covers the peripheral surface of the metallic core 2*a*. The surface layer 2*c* covers the peripheral surface of the heat resistant layer 2*b*. It is formed of a fluorinated resin, such as PFA, PTFE, etc., and is 30 μm in thickness.

The pressure roller 2 is rotationally disposed under the heat roller 1, in parallel to the heat roller 1, with its lengthwise end portions supported by a pair of bearings 26 attached to the front and rear plates 21 and 22, respectively, of the frame of the fixing apparatus F.

The heat roller 1 and pressure roller 2 are kept pressed upon each other by a pressure application mechanism (unshown), forming thereby the fixation nip N, which is roughly 5 mm in width in terms of the direction parallel to the recording sheet conveyance direction. Thus, as the recording sheet P is conveyed, while remaining pinched by the two rollers 1 and 2, through the fixation nip N, the unfixed toner image t on the recording sheet P is thermally fixed to the recording sheet P.

Here, the lengthwise direction of the structural components of this image forming apparatus is the direction parallel to the axial line of the image heating member (heat roller), that is, the direction which is parallel to the direction perpendicular to the direction in which the recording sheet P is conveyed, and which is also parallel to the plane which coincides with the fixation nip N. Further, the center and ends of each of the structural components are the center and ends of the components in terms of the lengthwise direction.

The coil assembly 3 disposed in the hollow of the heat roller 1 has: a bobbin 4, a metallic core 5 (magnetic core made up of sections 1, 2) made of a magnetic substance, a coil 6 (exciter coil), a stay 7 made of an electrically insulating substance, etc. The magnetic core 5 is supported by the bobbin 4. The coil 6 is made up of strands of electrical wire wound around the bobbin 4. The integral combination of the bobbin 4, magnetic core 5, and coil 6 makes up a coil unit, which is stationary held by the stay 7.

The coil assembly 3 is held by the front and rear walls 24 and 25 of the fixing apparatus, with the presence of a preset gap between the inward surface of the heat roller 1 and the coil 6, in such a manner that it does not rotate. More specifically, the lengthwise ends 7*a* of the stay 7 are supported by the front and rear walls of the fixing apparatus. The coil unit, that is, the integral combination of the bobbin 4, magnetic core 5, and coil 6 is disposed so that its lengthwise ends are not exposed outward from the lengthwise ends of the heat roller 1.

The magnetic core 5 is made up of a substance, such as ferrite, Permalloy, etc., which is high in magnetic permeability and low in residual magnetic flux density. It is for guiding the magnetic flux generated by the coil 6, to the heat roller 1. The magnetic core 5 in this embodiment is shaped so that its cross section is in the form of a letter T. It is made by combining two pieces 5(1) and 5(2) of magnetic plate, which are equivalent to the horizontal and vertical portions of the letter T, respectively.

Referring to FIG. 4, the coil 6 is made of a Litz wire wound multiple times around the bobbin 4 in a manner to conform to the contour of the bobbin 4, that is, in such a manner that the cross section of the resultant coil 6 appears like the cross section of a small boat whose bottom is parallel to the internal surface of the metallic core 1*a*. That is, the Litz wire is wound in the direction parallel to the rotational axis of the heat roller 1 to generate a magnetic flux perpendicular to the rotational axis of the heat roller 1 in order to heat the heat roller 1. That is, the Litz wire is wound so that the center line of the coil 6 becomes perpendicular to the rotational axis of the heat roller 1. Designated by referential codes 6*a* and 6*b* are the two lead wires (power supplying lines) of the coil 6. They are outwardly extended through the rear end of the stay 7, and are connected to a high frequency invertor 101 (high frequency power source), which is for applying a preset voltage to causes high frequency current to flow through the coil 6.

The high frequency invertor 101 has a switching element, which can be turned on or off to flow, or not to flow, electric current of a preset frequency through the coil 6. The high frequency invertor 101 in this embodiment is fixed in voltage (100 V). Thus, the amount of power supplied by the invertor 101 is determined by the variable current value and the length of time the electric current is flowed or not flowed (switching element is kept on, or off).

Designated by a referential number 11 is a thermistor, which is the temperature detecting member for detecting the temperature of the heat roller 1. This thermistor 11 will be described later.

Designated by a referential number 12 is a recording sheet guiding upstream plate, which guides the recording sheet P to the entrance of the fixation nip N, as the recording sheet P is conveyed to the fixing apparatus F from the image forming mechanism. Designated by a referential number 13 is a recording sheet separating claw, which is for separating the recording sheet P from the heat roller 1, that is, for preventing the recording sheet P from wrapping around the heat roller 1 as the recording sheet P comes out of the fixation nip N after being introduced into the fixation nip N. Designated by a referential number 14 is a recording sheet guiding downstream plate, which guides the recording sheet P toward the delivery tray as the recording sheet P comes out of the fixation nip N.

The abovementioned bobbin 4, stay 7, and recording sheet separating claw 13 are made of a heat resistant and electrically insulating engineering plastic.

Designated by an alphanumeric referential code G1 is a drive gear for driving the heat roller 1. The drive gear G1 is solidly attached to the rear end of the heat roller 1. The force for driving the heat roller 1 is transmitted to the drive gear G1 from a driving force source M1 through a driving force transmitting system. As the driving force is transmitted to the drive gear G1, the heat roller 1 is rotationally driven in the clockwise direction, that is, the direction indicated by an arrow mark A in FIG. 2, at a peripheral velocity of 300 mm/sec (in this embodiment). The pressure roller 2 is rotated by the friction between the pressure roller 2 and heat roller 1 in the fixation nip N, in the counterclockwise direction, that is, the direction indicated by an arrow mark B in FIG. 2. During an image heating operation, it rotates at a peripheral velocity of 300 mm/sec, while heating the toner image on the recording sheet P as the recording sheet P is conveyed through the fixation nip N.

Designated by a numeric referential code 15 is a heat roller cleaner consisting of a roll of cleaning web 15*a*, a shaft 15*b*, a shaft 15*c*, and a roller 15*d*. The shaft 15*b* is the shaft for holding the roll of cleaning web 15*a* so that the cleaning web 15*a* can be let out, whereas the shaft 15*c* is the shaft for taking up the cleaning web 15*a* let out by the shaft 15*b*. The roller 15*d* is the roller for keeping the web 15*a* pressed upon the peripheral surface of the heat roller 1, between the shafts 15*b* and 15*c*. That is, the peripheral surface of the heat roller 1 is wiped clean by the portion of the web 15*a*, which is kept pressed upon the peripheral surface of the heat roller 1 by the web pressing roller 15*d*. The web 15*a* is let out by the shaft 15*b* while being taken up by the shaft 15*c*. Thus, the portion of the cleaning web, which is in the nip, that is, the portion of the web, which is the current cleaning portion of the web 15*a*, is gradually replaced by the upstream portion of the web 15*a* in terms of the direction in which the web 15*a* is moved.

In this embodiment, the recording sheet P is conveyed so that the centerline of the recording sheet, which is parallel to the recording sheet conveyance direction, coincides with the centerline S (theoretical referential line) of the recording sheet passage of the image forming apparatus (image heating apparatus). That is, regardless of the size of recording sheets, the recording sheet P is conveyed through the fixing apparatus F so that the centerline of the recording sheet P corresponds with the center of the heat roller 1 in terms of the lengthwise direction. A recording sheet of the largest size (which hereafter may be referred to simply as large recording sheet), which can be conveyed through (used by) the image forming apparatus in this embodiment, is a recording sheet of size A3, for example, provided that the recording sheet P is conveyed so that its short edge (297 mm) becomes perpendicular to the recording sheet conveyance direction. A recording sheet of the smallest size (which hereafter may be referred to simply as small recording sheet), which can be conveyed through the image forming apparatus in this embodiment, is a recording sheet of size A5, for example, provided that the recording sheet is conveyed so that its short edge (148 mm) becomes perpendicular to the recording sheet conveyance direction. Designated by alphanumeric referential codes P1 and P2 in FIGS. 3 and 4 are the paths of large and small recording sheets, respectively.

The thermistor 11 is disposed in contact with the center portion of the heat roller 1, which roughly corresponds to the center portion of the path P2 of a small recording sheet. That is, the sheet passage includes the paths of recording sheets of all sizes conveyable through (usable with) the image forming apparatus in this embodiment. Thus, the thermistor 11 detects the temperature of the heat roller 1, at a point which falls within the recording sheet passage. Although the thermistor 11 in this embodiment is of the contact type, a thermistor of the noncontact type may be employed.

More specifically, the thermistor 11 is disposed so that it faces the coil 6, with the presence of the heat roller 1 between the thermistor 11 and coil 6, and also, so that it is kept pressed upon the peripheral surface of the heat roller 1 by an elastic member. Signals which represent the heat roller temperature detected by the thermistor 11 are inputted into a control circuit 100 (CPU), which is a means for controlling the amount by which electric current is flowed through the coil 6.

As the switch of the main power source of the image forming apparatus is turned on, the control circuit 100 starts up the fixing apparatus F (starts process of heating heat roller to preset temperature level). In this embodiment, this preset temperature level is the standby temperature level, that is, the target temperature level for the standby period. The rotation of the heat roller 1 is started by turning on the power source M1. The pressure roller 2 is rotated by the rotation of the heat roller 1. Further, the control circuit 100 powers up the high frequency invertor 101 to flow high frequency current through the coil 6. As the high frequency is flowed through the coil 6, an alternating high frequency magnetic flux is generated. As a result, heat is generated in the heat roller 1 (metallic core 1*a*) by electromagnetic induction, raising the temperature of the heat roller 1 to the preset startup level (200° C., in this embodiment). As the temperature of the heat roller 1 increases, it is detected by the thermistor 11, and the information regarding the detected temperature of the heat roller 1 is inputted into the control circuit 100.

As soon as the temperature of the heat roller 1 reaches the target startup level, the fixing apparatus is placed in the standby mode in which it waits for the inputting of an image formation signal. In the standby mode, the control circuit 100 controls the high frequency current power source so that the heat roller temperature detected by the thermistor 11 remains at the standby level Ts (which in this embodiment is 200° C.), which is the same as fixation temperature level Tf). That is, the control circuit 100 controls the high frequency invertor 101 so that the heat roller temperature detected by the thermistor 11 remains at a preset target temperature level T. As described above, the standby temperature level Ts and fixation temperature level Tf are lower than The Curie point, which will be described later.

As an image formation signal is inputted while the image forming apparatus is in the standby mode, a toner image t (unfixed) is formed on a recording sheet P in the image forming portion. Then, the unfixed toner image t is conveyed to the fixation nip N of the fixing apparatus F, through which the recording sheet P is conveyed, while remaining pinched by the heat roller 1 and pressure roller 2. While the recording sheet P is conveyed through the fixation nip N, the unfixed toner image t on the recording sheet P is fixed to the surface of the recording sheet P by the heat from the heat roller 1, the temperature of which is maintained at the preset fixation temperature level Tf, and the pressure applied by the heat roller 1 and pressure roller 2.

During the operation (image fixing operation) in which the heat roller 1 heats the recording sheet P, the control circuit 100 controls the high frequency current applied to the coil 6 from the high frequency invertor 101 so that the heat roller temperature detected by the thermistor 101 remains at the fixation temperature level Tf. That is, during the image fixing operation, the amount by which electric power is supplied to the coil 6 is adjusted in response to the difference between the heat roller temperature detected by the thermistor 11 and the fixation temperature level Tf. As described above, in this embodiment, instead of adjusting the amount by which electric power is supplied to the coil 6 in response to the impedance of the coil 6 detected in real time, the amount by which electric power is supplied to the coil 6 is selected in response to the difference between the heat roller temperature detected by the thermistor 11 and the fixation temperature level, from among the preset values.

Figure 5:
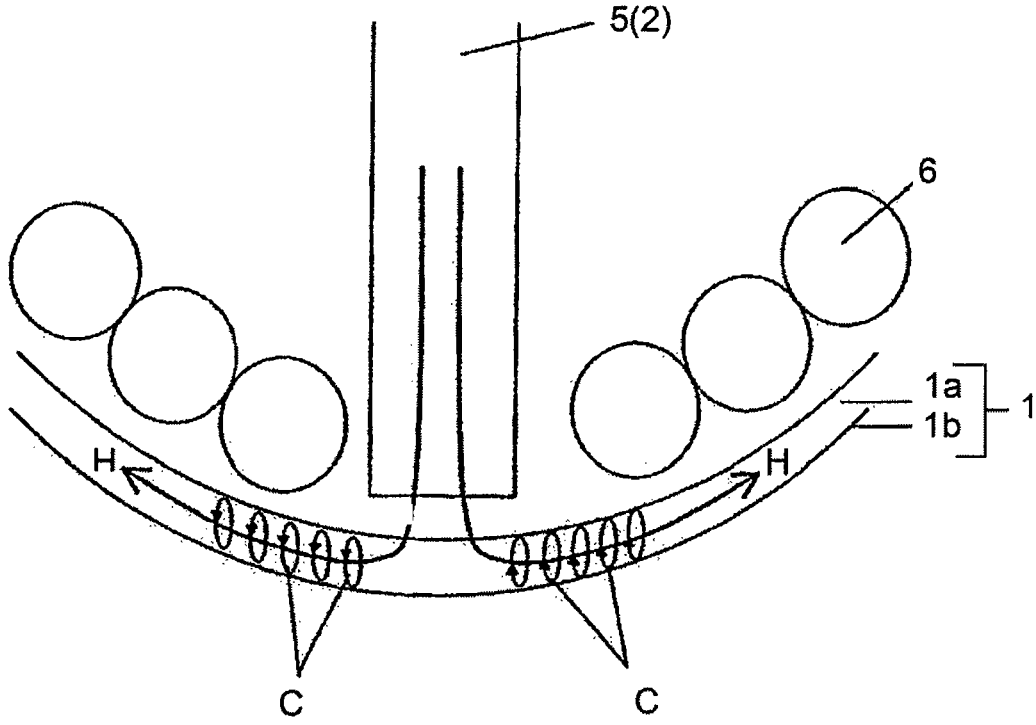
FIG. 5 is a drawing for showing the principle on which the heat generation of the heat roller is based.

At this time, referring to FIG. 5, the principle, based on which heat is generated in the metallic core 1*a* of the heat roller 1*a* by electromagnetic induction, will be described. As alternating current is flowed through the coil 6 by the high frequency invertor 101, magnetic fluxes, indicated by referential codes H, repeatedly generates and vanishes. The magnetic fluxes H are guided through the magnetic flux passage created by the cores 5(1, 2) and metallic core 1*a*. As the magnetic fluxes generated by the coil 6 change, an eddy current generates in such a manner as to generate magnetic fluxes which counter the change in the magnetic fluxes generated by the coil 6. This eddy current is designated with an arrow mark C in the drawing.

This eddy current C concentrates to the surface portion (skin) of the metallic core 1*a*, which is on the coil side (skin effect). Thus, heat is generated by the amount of electric power, which is proportional to skin resistance Rs (Ω) of the metallic core 1*a*.

The skin depth δ (μm) and skin resistance Rs (Ω), which can be obtained from the frequency f (Hz) of the alternating current flowing through the coil 6, magnetic permeability μ (H/m), specific resistance ρ (Ω×m), with the use of the following formulas (1) and (2), respectively.

$$\delta(\text{mm})=\sqrt{\rho/\pi f\mu}\times 10^3 \quad (1)$$

$$Rs=\rho/\delta=\sqrt{\pi f\mu\rho} \quad (2)$$

As for the amount W of electric power generated in the wall of the metallic core 1*a* can be obtained with the use of the following formula (3), in which If (A) stands for the amount by which eddy current is induced in the wall of the metallic core 1*a*.

$$W\propto Rs\int|If|^2 dS \quad (3)$$

Thus, all that is necessary to increase the amount by which heat is generated in the wall of the metallic core 1*a* is to increase the amount If by which eddy current is generated, or to increase the metallic core 1*a* in skin resistance Rs.

All that is necessary to increase the amount by which the eddy current If is induced is to raise the level of strength at which the magnetic fluxes are generated by the coil 6, or to increase the amount by which the magnetic fluxes are changed. For example, it can be achieved by increasing the number by which the Litz wire is wound to make the coil 6, or using a substance which is higher in magnetic permeability and lower in residual magnetic flux density, as the material for the magnetic core 5. Further, the amount by which the eddy current If is induced can be increased by reducing the gap d between the magnetic core 5 and the wall of the metallic core 1*a*, because the reduction in the gap d increases the amount by which the magnetic fluxes are guided into the wall of the metallic core 1*a*.

On the other hand, what is necessary to increase the wall of the metallic core 1*a* in skin resistance Rs is to increase in frequency the alternating current flowed through the coil 6, or to use a substance higher in magnetic permeability μ and specific resistivity, as the material for the metallic core 1*a*.

Next, the Curie point Tc will be described. Generally, as ferromagnetic substances are heated to their Curie points Tc, they reduce in spontaneous magnetization, reducing thereby in magnetic permeability μ. Further, as the wall of the metallic core 1*a*, which is the electrically conductive portion of the heat roller 1, exceeds in temperature the Curie point Tc of the substance, of which the metallic core 1*a* is made, the wall of the metallic core 1*a* reduces in skin resistance Rs, reducing thereby the amount W by which heat is generated in the wall of the metallic core 1*a*.

As will be evident from Formula (2), generally, the amount of the skin resistance of the wall of the metallic core 1*a* is determined by the magnetic permeability μ and resistivity ρ of the wall of the metallic core 1*a*, provided that the current flowing through the wall of the metallic core 1*a* remains stable in frequency. Further, the resistivity μ of the wall of the metallic core 1*a* gradually increases with the increase in the temperature of the metallic core 1*a*.

The amount of the resistance (skin resistance) Rs of the heat roller 1 corresponds to the apparent amount of load resistance of the heat roller 1, which is measured when electric current is flowed through the coil 6, with the heat roller 1 fitted with the magnetic flux generating means.

The method for measuring the amount of the apparent resistance of the heat roller 1, and the dependency of the electrical resistance of the heat roller 1 upon the temperature, are as follows: The amount of the resistance of the heat roller 1 is measured with an LCR meter (model HP4194A: product of Agilent Technologies Co., Ltd.) while flowing an alternating current which is 20 kHz in frequency, with the image heating apparatus fitted with the heat roller 1, exciter coil (magnetic flux generating means), and core. The graph which shows the characteristic curve of the heat roller 1, regarding the relationship between the amount of resistance of the heat roller 1 and the temperature of the heat roller 1, can be obtained by plotting the amount of resistance of the heat roller 1 measured while the heat roller 1 increases in temperature.

Further, the temperature of the heat roller 1 is changed in a thermostatic chamber while keeping stable the positional relationship between the heat roller 1 and magnetic flux generating means, with the image heating apparatus fitted with the heat roller 1 and magnetic flux generating means. Further, the amount of the resistance of the heat roller 1 is measured with the use of the method described above, after the heat roller temperature reaches the temperature of the thermostatic chamber.

Figure 6:
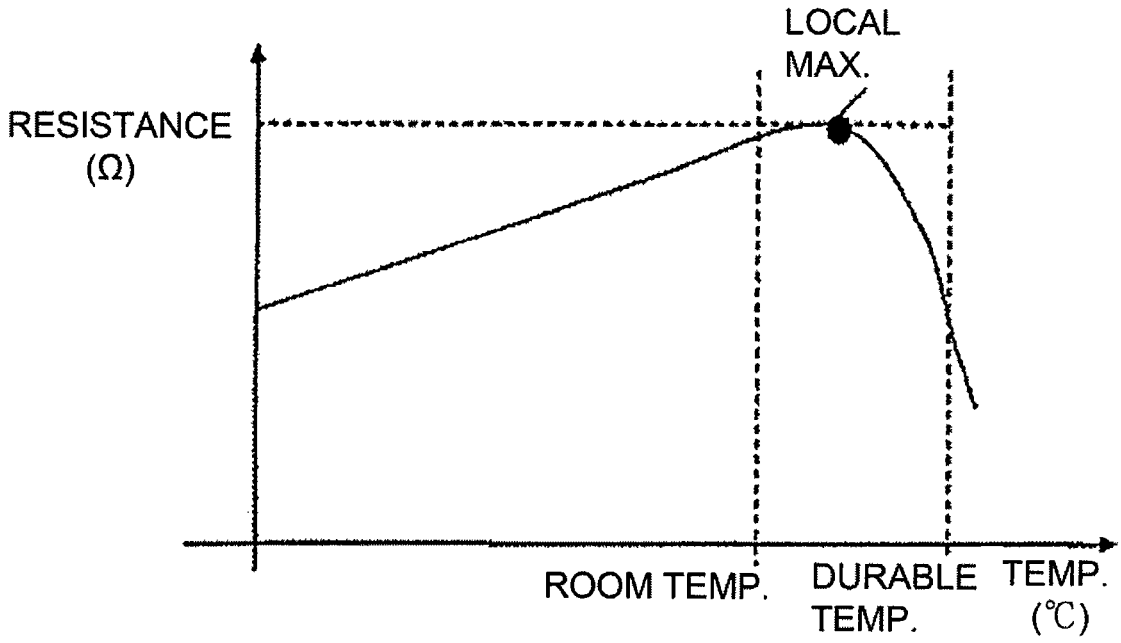
FIG. 6 is a graph which shows the dependency of electrical resistance upon temperature.

As the measured amounts of resistance of the heat roller 1 and the temperature levels at which the amount of resistance of the heat roller 1 were measured are plotted in the form of a graph, the vertical and horizontal axes of which represent the amounts of resistance of the heat roller 1 and the temperature of the heat roller 1, the dependency of the amount of resistance of the heat roller 1 upon the temperature of the heat roller 1 emerges as a curved line given in FIG. 6.

The method used for measuring the magnetic permeability of the heat roller 1 is as follows: The device used to measure the magnetic permeability was a B-H analyzer (model SY-8283: product of Iwatsu Test Instruments Co., Ltd.). Predetermined wires for the primary and secondary coils were wound around the heat roller to be measured in magnetic permeability, with the current frequency set to 20 kHz. The test samples may be any shape as long as the wires for the primary and secondary coils can be wound around it (ratio between permeability measure at given temperature level and that measured at another temperature level remains virtually the same).

After the wires were wound around the sample, the sample was placed in the thermostatic chamber, and left therein until the temperature of the sample became equal to that of the chamber. Then, the sample was measured in magnetic permeability. Then, the obtained magnetic permeability values of the same were plotted. The curved line which shows the dependency of the magnetic permeability of the heat roller 1 upon the temperature of the heat roller 1 was obtained by varying the temperature of the thermostatic chamber. As the temperature of the thermostatic chamber was increased, the magnetic permeability of the sample stopped changing at a certain temperature level; it did not change beyond this level. This temperature level, or the temperature level beyond which the magnetic permeability of the sample did not change, is the Curie point of the sample.

Figure 7:
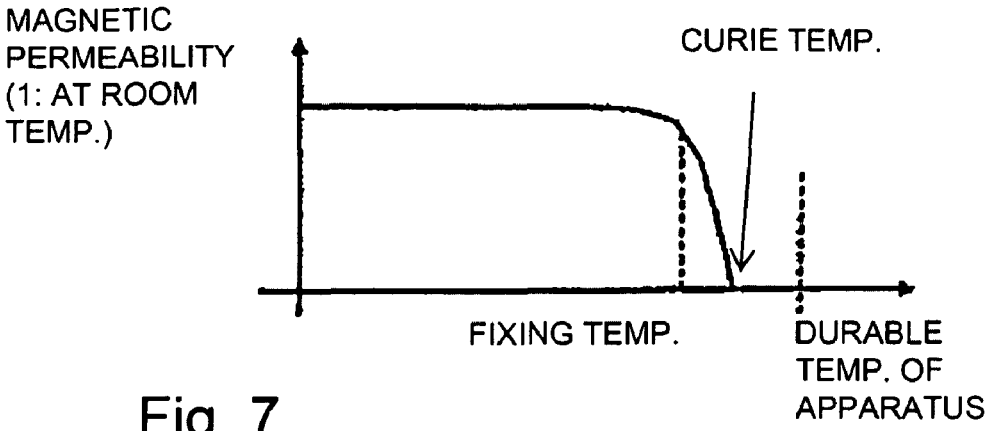
FIG. 7 is a graph which shows the dependency of magnetic permeability upon temperature.

As the magnetic permeability of the heat roller 1 was measured with the use of the above described method, the dependency of the magnetic permeability of the heat roller was as shown by the curved line in FIG. 7.

Figure 8:
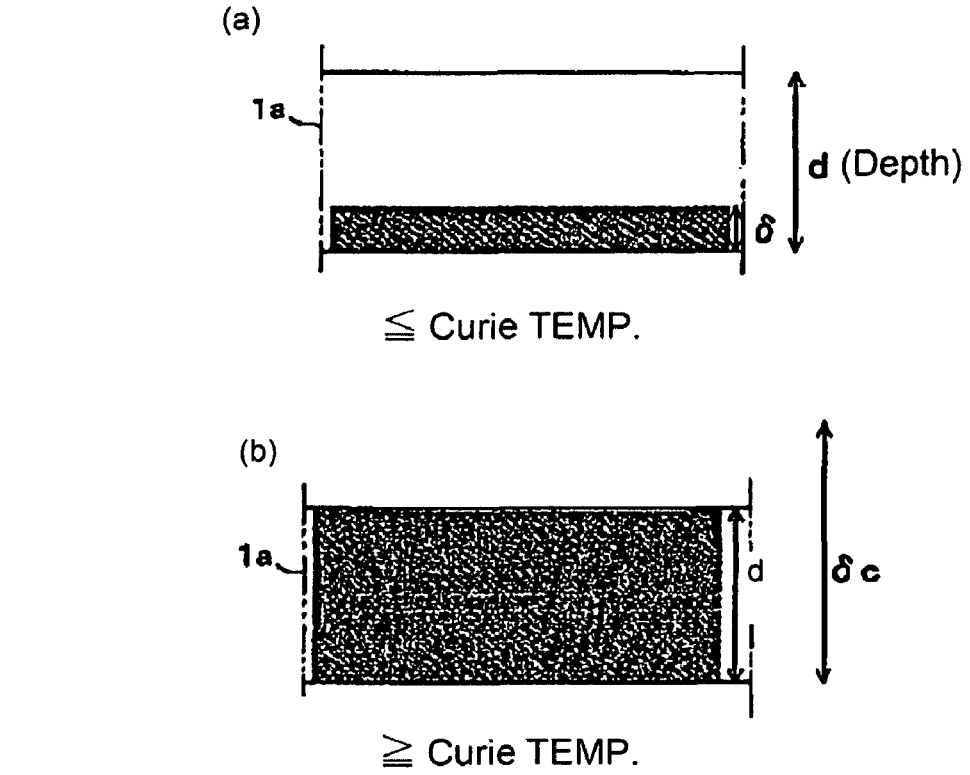
FIG. 8 is a schematic drawing which shows the portion of the metallic core, in which eddy current is induced.

FIG. 8 is a schematic sectional view of the metallic core 1*a*, which shows the portion(s) of the heat roller 1 (metallic core 1*a*) to which eddy current concentrates. FIG. 8(*a*) represents a case where the thickness d (mm) of the metallic core 1*a* is greater than the skin depth δc (mm) of the metallic core 1*a*. FIG. 8(*b*) represents a case where the temperature of the metallic core 1*a* is no less than the Curie point Tc. In the latter case, that is, in the case where the thickness d (mm) of the metallic core 1*a* is less than the skin depth δc (mm) of the metallic core 1*a*, the eddy current flows through the entirety of the metallic core 1*a*, in terms of its cross section. Thus, the amount by which heat is generated in the metallic core 1*a* is smaller. In this case, therefore, the temperature of the heat roller 1 spontaneously converges to the saturation point, that is, the point at which the amount by which heat is generated by the heat roller 1 is equal to the amount by which heat radiates away from the heat roller 1.

That is, referring to FIG. 3, which shows the structure of the fixing apparatus F in this embodiment, the temperature of the path P2 of the small recording sheet is maintained at fixation temperature level Tf, whereas the portions of the recording sheet passage, which are outside the path P2 of the small recording sheet, reduces in temperature, because the temperature of the heat roller 1 spontaneously converges to the saturation point as described above.

Figure 9A:
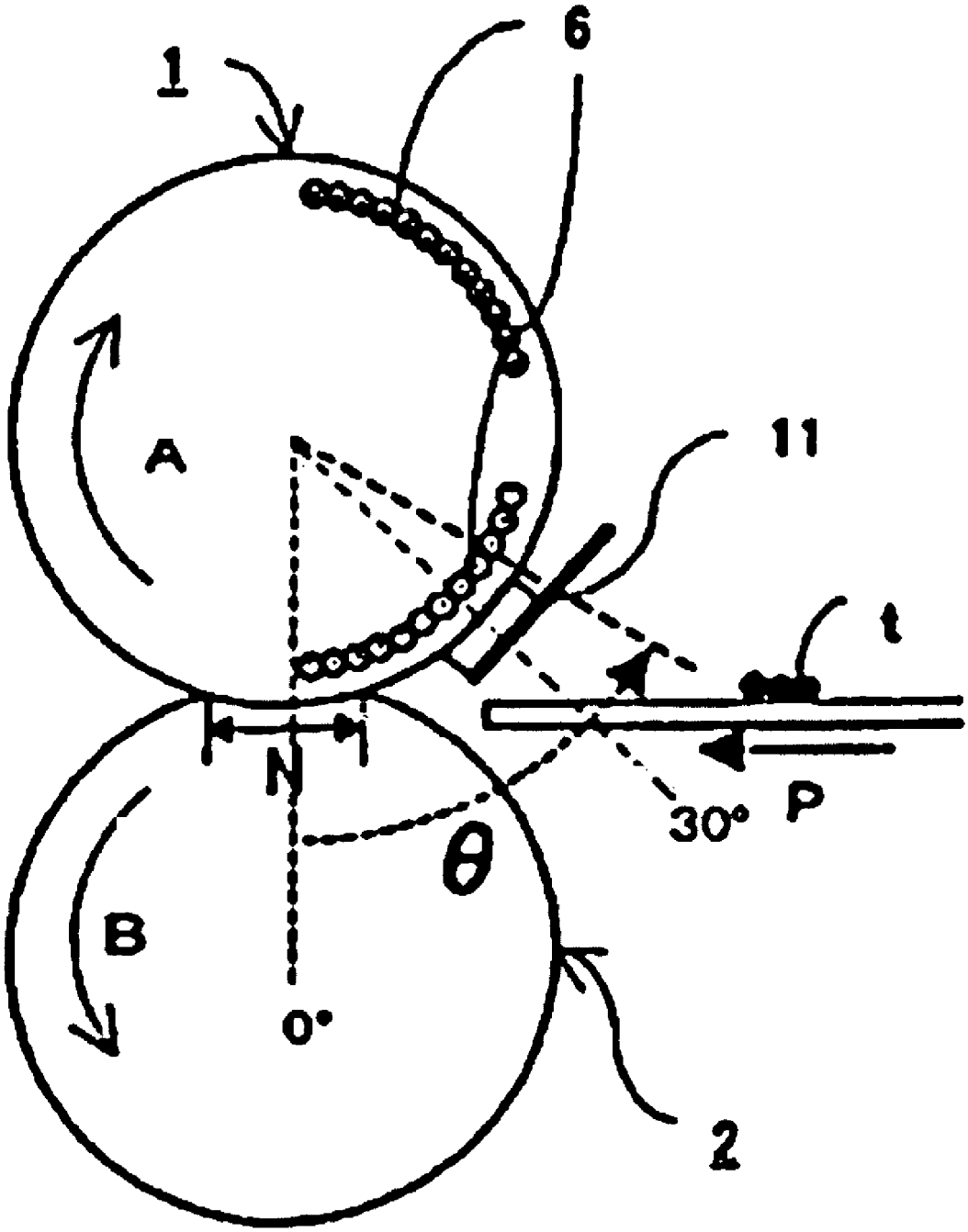
FIG. 9A is a schematic sectional view of the heat roller and its adjacencies in the first preferred embodiment, showing the structures thereof.
Figure 9B:
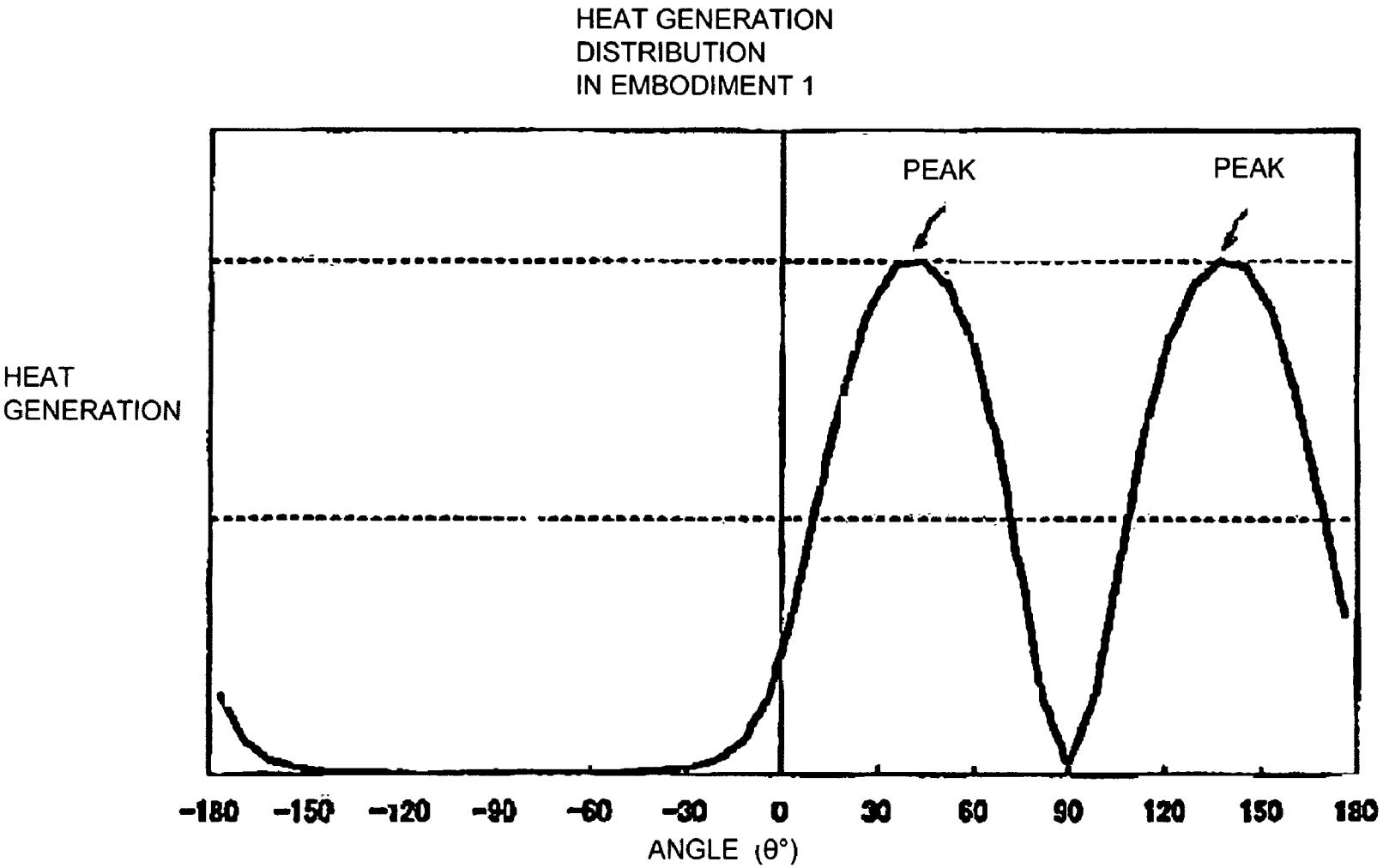
FIG. 9B is a graph which shows the distribution of the heat generation amount of the heat roller in the first preferred embodiment, in terms of the circumferential direction of the roller.
Figure 9C:
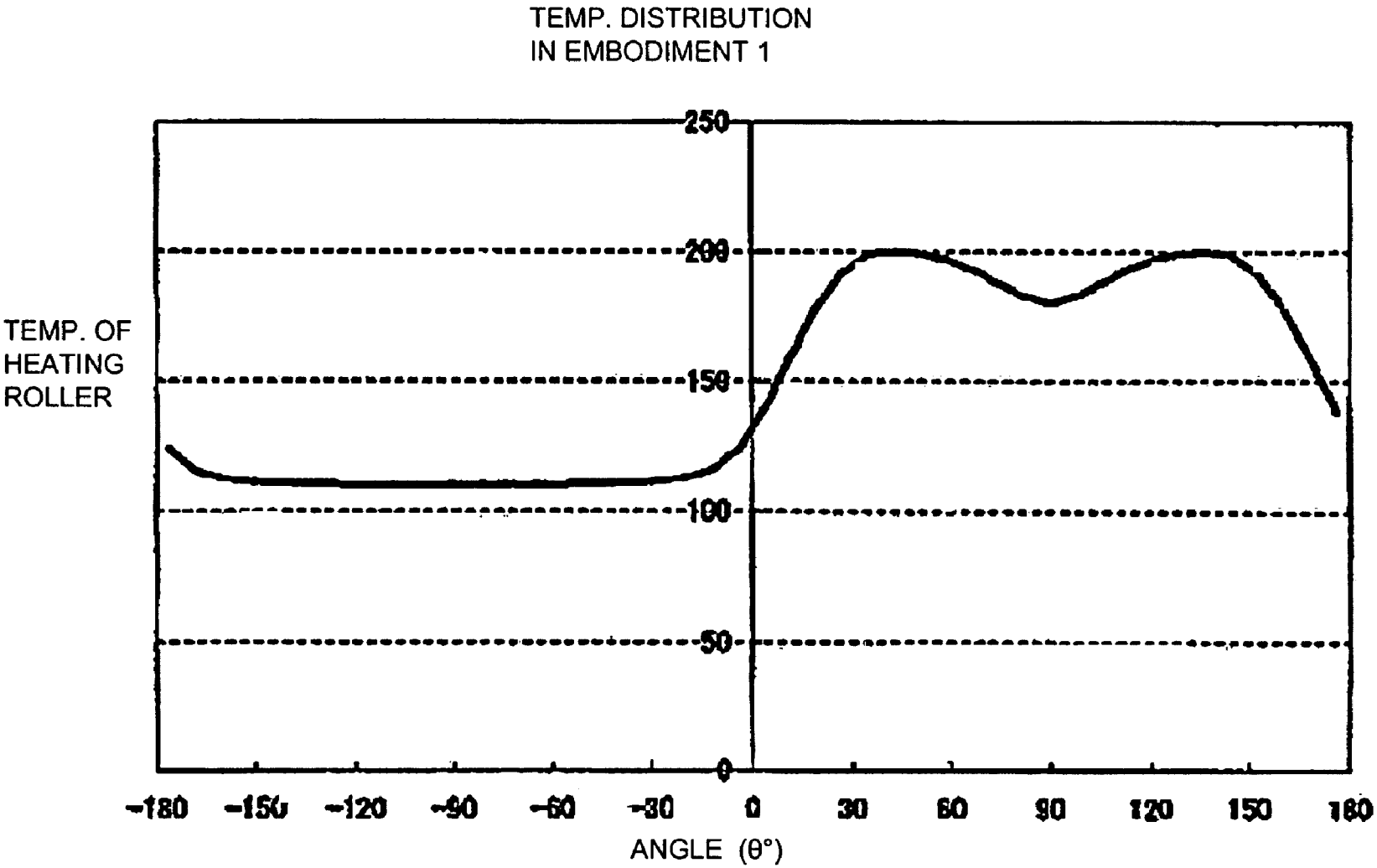
FIG. 9C is a graph which shows the temperature distribution of the heat roller in the first preferred embodiment, in terms of the circumferential direction of the roller.

Next, the distribution of the heat generation amount of the heat roller 1, and the temperature distribution of the heat roller 1, in terms of the circumferential direction of the heat roller 1, will be described. Referring to FIG. 9A, designated by a Greek letter θ is the angle relative to the vertical plane coinciding with the axial lines of the heat roller 1 and pressure roller 2, and the center of the fixation nip N (formed as heat roller 1 and pressure roller 2 are pressed upon each other) in terms of its widthwise direction. That is, the abovementioned plane is where θ=0°. Further, the upstream angle relative to the plane (where θ=0°) in terms of the rotational direction of the heat roller 1, is defined as positive angle (0-+180° C.), and the downstream angle relative to the plane is defined as negative angle (0-−180°). Given in FIG. 9B is the distribution of the heat generation amount of the heater roller 1 (metallic core 1*a*) in this embodiment, in terms of the circumferential direction of the heat roller 1. Given in FIG. 9C is the temperature distribution of the heat roller 1 in this embodiment, in terms of the circumferential direction of the heat roller 1.

As for the method for obtaining the distribution of the heat generation amount of the heat roller 1, the Joule loss density distribution (heat generation distribution) was obtained by two-dimensionally analyzing the magnetic field with the use of JMAG-Studio, which is an electromagnetic field analysis software (product of Nippon Soken Solutions Co., Ltd.).

Incidentally, the method for obtaining the heat generation amount distribution does not need to be limited to the abovementioned one; one of other electromagnetic field analysis software than the abovementioned one may be used. Further, the heat generation amount distribution may be substituted with the distribution of the temperature increase ΔT, that is, the temperature distribution of the heat roller 1, in terms of the circumferential direction of the heat roller 1, which is obtained by heating the heat roller 1 for a relatively short length of time, with the heat roller 1 kept stationary, and also, with the pressure roller 2 separated from the heat roller 1.

Next, regarding the method for obtaining the temperature distribution of the heat roller 1, the heat roller 1 is kept stationary for a predetermined length of time (which in this embodiment is 5 minutes), and the surface temperature of the heat roller 1 was measured while a control was executed to keep the temperature of the heat roller 1 at 200° C., which is the standby temperature level Ts in this embodiment. In this embodiment, when the fixing apparatus F is kept on standby, the heat roller 1 is kept stationary.

Referring to FIG. 9B, in the case of the fixing apparatus F in this embodiment structured as described above, the peak of the heat generation amount distribution roughly coincides with the portion of the heat roller 1, which is in contact with the thermistor 11 (+30° in FIG. 9A), and the control is executed to keep the temperature of this portion of the heat roller 1 at roughly 200° C. Further, the portion of the heat roller 1, which is in the opposite range from the coil 6 (0°-180° in FIG. 9B), there is no specific peak, and the temperature of this portion is lower than the portion which corresponds in position to the thermistor 11.

The heat roller 1, that is, the image heating member, is uneven in heat generation amount distribution in terms of its rotational direction, and the thermistor 11 detects the temperature of the heat roller 1 at the point where the amount of heat generation by the heat roller 1 is greatest. That is, the thermistor 11 is disposed so that its position corresponds to the highest peak of the Joule loss density distribution of the heat roller 1, which is formed of a magnetic alloy. The temperature of the heat roller 1 is controlled so that the temperature of the portion of the heat roller 1, which corresponds in position to the thermistor 11 remains at the target temperature level, which is set to be lower than the Curie point. If the heat generation amount distribution has multiple peaks, the magnetic flux generating means should be adjusted in the number of winds of the coil 6, gap between the coil 6 and metallic core 1, positioning of the magnetic core 5, etc., to create the highest peak, and the thermistor 11 should be disposed so that its position corresponds to the created highest peak. Incidentally, in a case where a thermal switch is employed as a safety element, it also should be disposed so that its position corresponds to the highest peak. Although the thermistor 11 in this embodiment is disposed so that its position corresponds to the highest peak of the heat generation amount distribution of the heat roller 1, where the thermistor 11 is to be located does not need to be limited to the position in this embodiment, as long as no portion of the heart roller 1, in terms of the circumferential direction of the heat roller 1, becomes higher in temperature than the Curie point.

For comparison, the thermistor 11 is disposed so that its position corresponds to the opposite side of the heat roller 1 from the fixation nip N (180° away from fixation nip N). Then, recording sheets P were conveyed through the fixing apparatus F while controlling the high frequency current so that the temperature of the portion of the heat roller 1, which corresponds to the position of the thermistor 11, remains at 200° C. In this case, the temperature of the portion of the heat roller 1, which corresponds in position to the highest peak of the heat generation amount distribution, exceeded Curie point, across the entirety of the heat roller 1 in terms of the circumferential direction of the heat roller 1. As a result, the amount by which current was flowed through the coil 6 by the high frequency power source 101 increased, causing the power source to break down.

Figure 10:
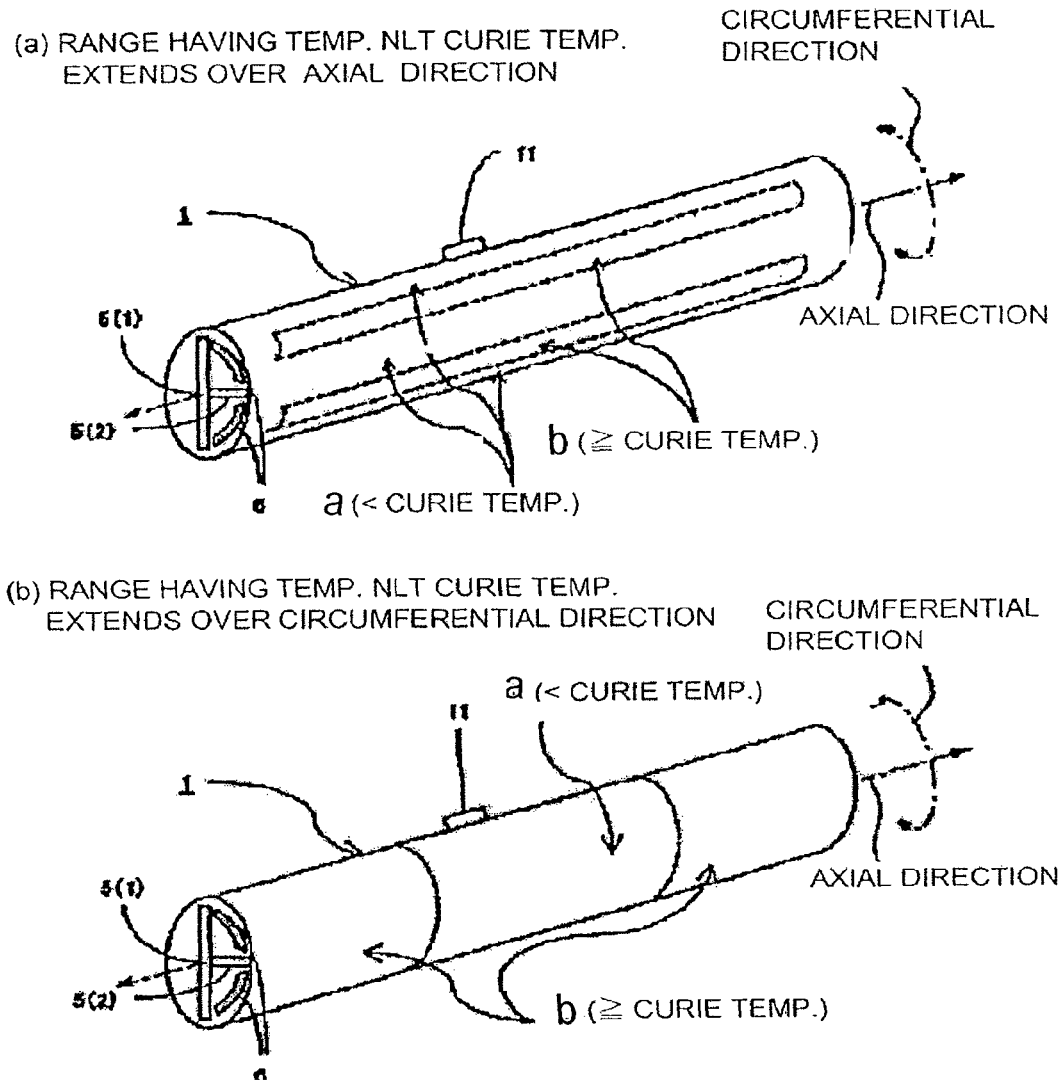
FIG. 10 is a drawing which conceptually shows the portions of the heat roller, the temperature of which is higher than The Curie point.

FIG. 10(*a*) depicts a case where some portions of the heat roller 1 in terms of the circumferential direction of the heat roller 1 are higher in temperature than the Curie point. In this case, the portion b of the heat roller 1, the temperature of which is higher than Curie point, is extremely small in load resistance, whereas the portions a, that is, the portions other than the portions b, is greater in load resistance than the portions b. As seen from the coil side, the load resistance of the portions a and the load resistance of the portions b are in parallel connection, and therefore, the amount by which current is flowed through the portions of the coil 6, which correspond to the portions b, that is, the portions which are smaller in load resistance, is greater than the amount by which current is flowed through the portions of the coil 6, which correspond to the portions a, that is, the portions which are larger in load resistance.

Thus, the position of the thermistor 11 and the target temperature for the thermistor 11 have to be determined so that the temperature of no portion of the heat roller 1 in terms of the circumferential direction of the heat roller 1 exceeds the Curie point Tc.

FIG. 10(*b*) depicts a case where some portions of the heat roller 1 in terms of the direction parallel to the axial line of the heat roller 1 have become higher in temperature than the Curie point. In this case, the load resistance of the coil 6, which corresponds to each of the portions A and the load resistance of the coil 6, which corresponds to each of the portions b, are in serial connection. Therefore, it does not occur that current is flowed through the coil 6 by such a large amount as the amount by which current is flowed in the case depicted in FIG. 10(*a*).

Whether the heat roller 1 (Curie roller) is rotating or not, the depictions given in FIGS. 10(*a*) and 10(*b*) remains the same. Since the portions of the heat roller 1, which are directly facing the coil 6, are greater in the amount of heat generation than the portion of the heat roller 1, which are not directly facing the coil 6, it is the portions of the heat roller 1, which are directly facing the coil 6, that are likely to exceed in temperature the Curie point.

That is, in this embodiment, the position of the thermistor 11 relative to the heat roller 1, and the target temperature level T for the control executed by the control circuit 100 to control the temperature of the heat roller 1, are predetermined so that the temperature of no portion of the heat roller 1 in terms of both the direction parallel to the rotational axis of the heat roller 1 and the circumferential direction of the heat roller 1 exceeds the Curie point. Therefore, it does not occur that an excessive amount of current is flowed through the coil 6. Therefore, it does not occur that the high frequency power source excessively increases in temperature, or breaks down.

While the heat roller 1 is heating a recording sheet, the control circuit 100 executes such a control that the temperature of the portion of the heat roller 1, in terms of the direction parallel to the axial line of the heat roller 1, which corresponds to the path of the recording sheet, is kept at the target temperature level Tf for fixation (fixation temperature level), which is lower than the Curie point Tc. The temperature of the portions of the heat roller 1, which correspond to the portions of the recording sheet passage, which are outside the recording sheet path, spontaneously converges to the saturation level, which is higher than the target temperature Tf (fixation temperature), because of the characteristics of the magnetic alloy.

While the heat roller 1 is kept on standby, that is, while the heat roller 1 is kept ready for heating a recording sheet, the heat roller 1 is controlled in temperature so that the temperature of no portion of the heat roller 1, in terms of both the direction parallel to the axial line of the heat roller 1 and the circumferential direction of the heat roller 1, becomes higher than the Curie point Tc. That is, the position of the thermistor 11 relative to the heat roller 1, and the target temperature level T for the heat roller temperature control carried out by the control circuit, are set to the standby temperature level Ts. Therefore, it does not occur that an excessive amount of current is flowed through the coil 6. Therefore, it does not occur that the high frequency power source excessively increases in temperature, and/or breaks down.

The above described structural arrangement is very effective, in particular, in the case of a system (fixing apparatus) in which the temperature of the heat roller 1 is controlled in such a manner that it is kept at the standby level Ts while the heat roller 1 is kept stationary in the standby mode.

This embodiment was described assuming that the Curie point Tc of the magnetic alloy was 210° C., and the standby temperature level Tc and fixation temperature level Tf were 200° C. This embodiment, however, is not intended to limit the present invention in scope. For example, the standby temperature level Ts may be lower than the fixation level Tf. That is, in consideration of the properties of the toner used for image formation, structure of the heating apparatus, heat generation amount distribution of the heater roller 1, temperature ripples and/or overshoot attributable to the control of the high frequency power source, tolerance of the temperature detecting means, etc., the material for the metallic core 1*a* may be designed to achieve a Curie point suitable for a specific fixing apparatus, and also, the target temperature level for the control of the fixing apparatus may be determined accordingly. Further, the present invention can be applied to a fixing apparatus which is provided with multiple standby temperature levels and multiple fixation temperature levels, which can be selected according to the thickness of the recording sheets P used for image formation.

Further, the fixing apparatus in this embodiment was structured so that while it was kept on standby, its heat roller was kept stationary, and the temperature of its heat roller 1 was controlled by the current controlling means. However, for the purpose of preventing the temperature of the heat roller 1 becoming nonuniform in terms of the circumferential direction of the heat roller 1, it is feasible to design a fixing apparatus so that, the heat roller 1 is continuously or intermittently rotated at a low speed, more specifically, a speed in a range of 50 mm/sec-100 mm/sec, which is slower than the speed at which the heat roller 1 is rotated when heating an image. Also in such a case, positioning the heat roller temperature detecting member as it is in this embodiment can ensure that in terms of both the circumferential direction and the direction parallel to the axial line of the image heating member, no portion of the image heating member will become higher in temperature than the Curie point.

Regarding the positioning of the temperature detecting member relative to the image heating member, in essence, the temperature detecting member is positioned so that in terms of both the circumferential direction of the image heating member and the direction parallel to the axial line of the image heating member, no portion of the image heating member will become higher in temperature than the Curie point when the fixing apparatus is kept in the standby state, in which the image heating member is kept stationary and the current to the image heating member is controlled to keep the temperature of the image heating member lower than the Curie point. Further, while the image heating member is rotated at a speed less than the speed at which it is rotated when heating an image, and the current to the image heating member is controlled to keep the temperature the image heating member at a lower level than the Curie point.

Further, the fixing apparatus in this embodiment is an image heating apparatus which uses the heat roller 1. However, the present invention is also applicable to a fixing apparatus of the belt-type, that is, a fixing apparatus whose image heating member is an endless belt, which will be obvious. Further, the present invention is applicable to a fixing apparatus, the image heating member of which is a clad roller, that is, a roller made up of multiple layers of metallic substances different in properties, as long as one of the metallic layer is formed of a magnetic alloy.

Further, the heating apparatus (fixing apparatus) in this embodiment is usable with a color image forming apparatus which forms a color image by layering multiple monochromatic toner images, different in color. Such usage can provide the same effects as those described above.

Further, in this embodiment, the coil 6 was disposed in the hollow of the heat roller 1. However, the present invention is applicable to a fixing apparatus (image heating apparatus), the coil 6 of which is outside the heat roller 1. However, in a case where the present invention is applied to such a fixing apparatus, it is desired that the thermistor for detecting the temperature of the heat roller 1 is disposed in the hollow of the heat roller 1, or where the exciter coil is not present, if the exciter is disposed outside the heat roller 1.

Embodiment 2

Next, referring to FIGS. 11 and 12, the second preferred embodiment of the present invention will be described. In the second preferred embodiment, the exciter coil is positioned to simultaneously heat virtually the entirety of the heat roller 1 (image heating member) in terms of the circumferential direction of the heat roller 1.

Figure 11:
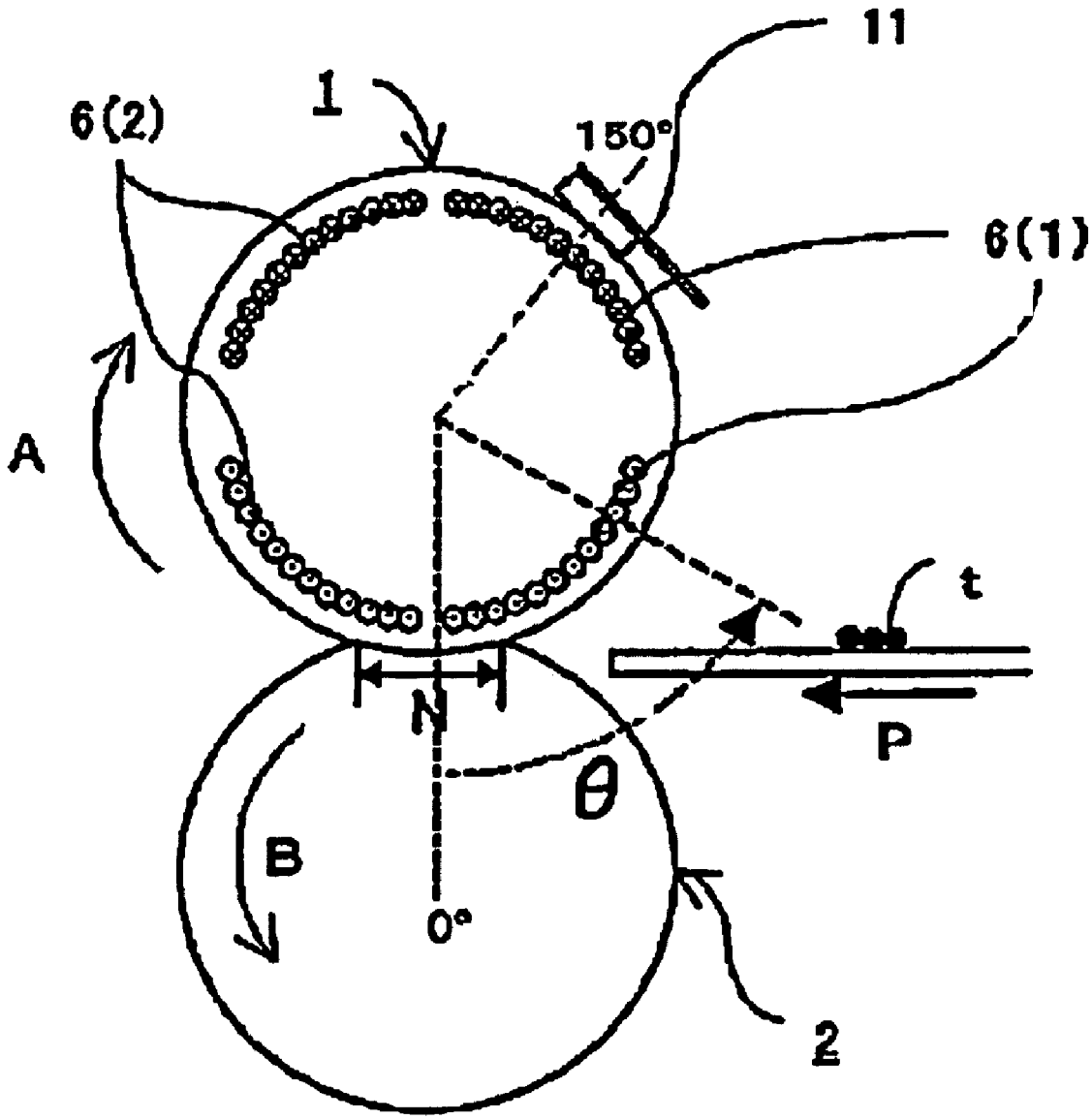
FIG. 11 is a schematic sectional view of the heat roller in the second preferred embodiment, showing the structure of the roller.

Referring to FIG. 11, here, regarding the position of a given point of the heat roller 1 in terms of the angle θ relative to the plane which coincides with the axial line of the heat roller 1 and pressure roller 2, the portion which coincides with the center of the fixation nip N formed by keeping the heat roller 1 and pressure roller 2 pressed upon each other, is the portion, the angle θ of which is 0° (θ=0°). Further, the upstream angle relative to the plane (where θ=0°) in terms of the rotational direction of the heat roller 1, is defined as positive angle (0-+180° C.), and the downstream angle relative to the plane is defined as negative angle (0--180°).

The fixing apparatus in this embodiment is provided with an upstream coil 6(1) and a downstream coil 6(2). The upstream coil 6(1) is for generating a magnetic flux across the portion of the heat roller 1, which is in the angular range of 0-+180°. The downstream coil 6(2) is for generating a magnetic flux across the portion of the heat roller 1, which is in the angular range of 0--180°. The Curie point of the heat roller 1 is 210° C.

Thus, virtually the entirety of the heat roller 1 is simultaneously heated by the combination of the upstream and downstream coils 6(1) and 6(2). Therefore, the heat roller 1 in this embodiment is significantly less nonuniform in temperature in terms of its circumferential direction, making it unnecessary to be rotated to be prevented from becoming nonuniform in temperature while the fixing apparatus is kept on standby. Thus, this embodiment makes it possible to provide a heating apparatus which is significantly smaller in power consumption than the image forming apparatus in the first embodiment. In this embodiment, while the image heating apparatus is kept on standby, the heat roller 1 is kept stationary, and is controlled so that its temperature remains at the standby level Ts.

The upstream and downstream coils 6(1) and 6(2) are connected in parallel to the high frequency power source. Therefore, they are the same in terms of the high frequency current which flows through them.

In this embodiment, the thermistor 11 is on the upstream side of the fixation nip N, and the high frequency current is flowed through both the upstream and downstream coils 6(1) and 6(2) so that the temperature of the heat roller 1, which is measured at the point corresponding to the fixation nip N remains at 200° C.

Figure 12A:
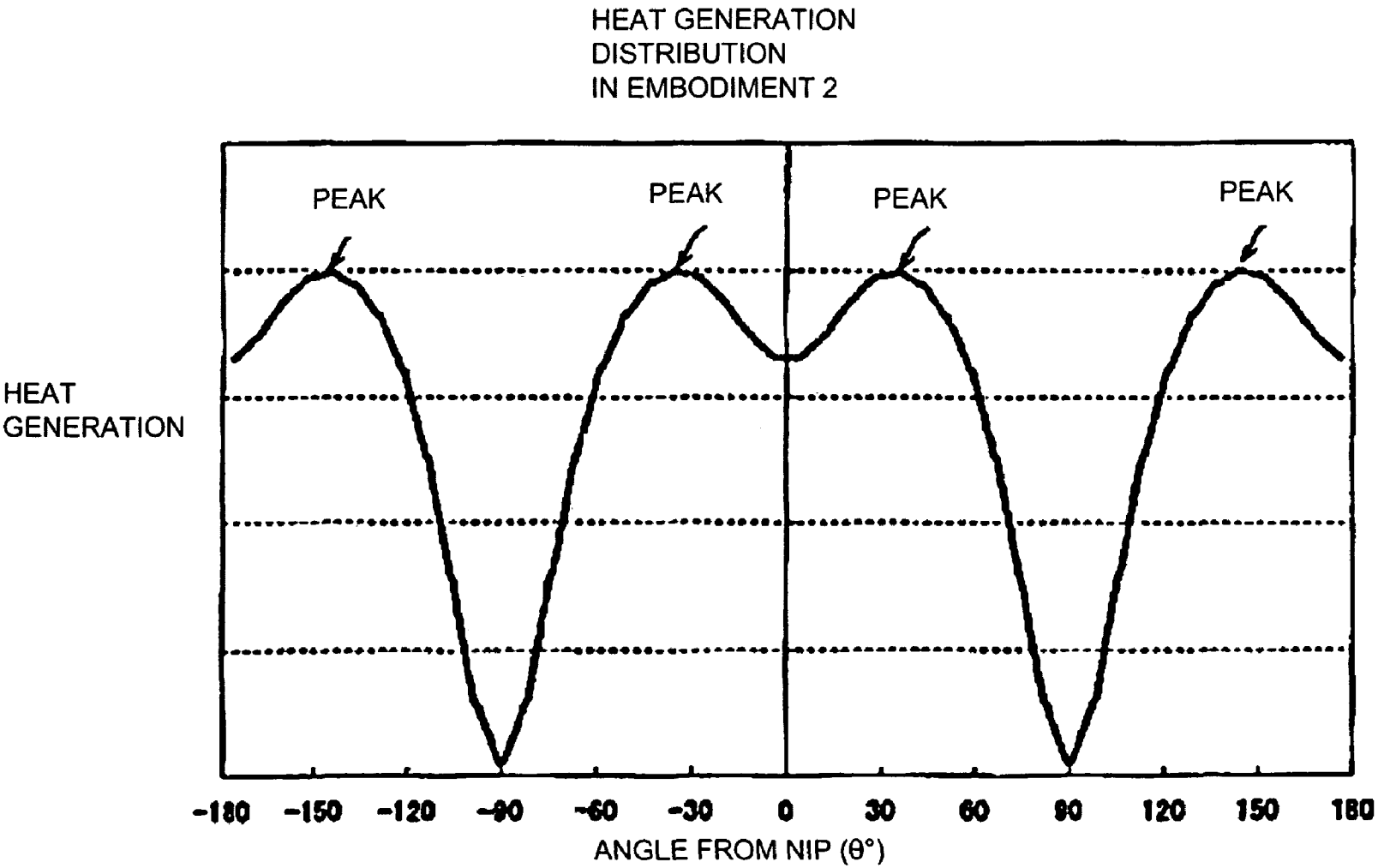
FIG. 12A is a graph which shows the distribution of the heat generation amount of the heat roller in the second preferred embodiment, in terms of the circumferential direction of the roller.
Figure 12B:
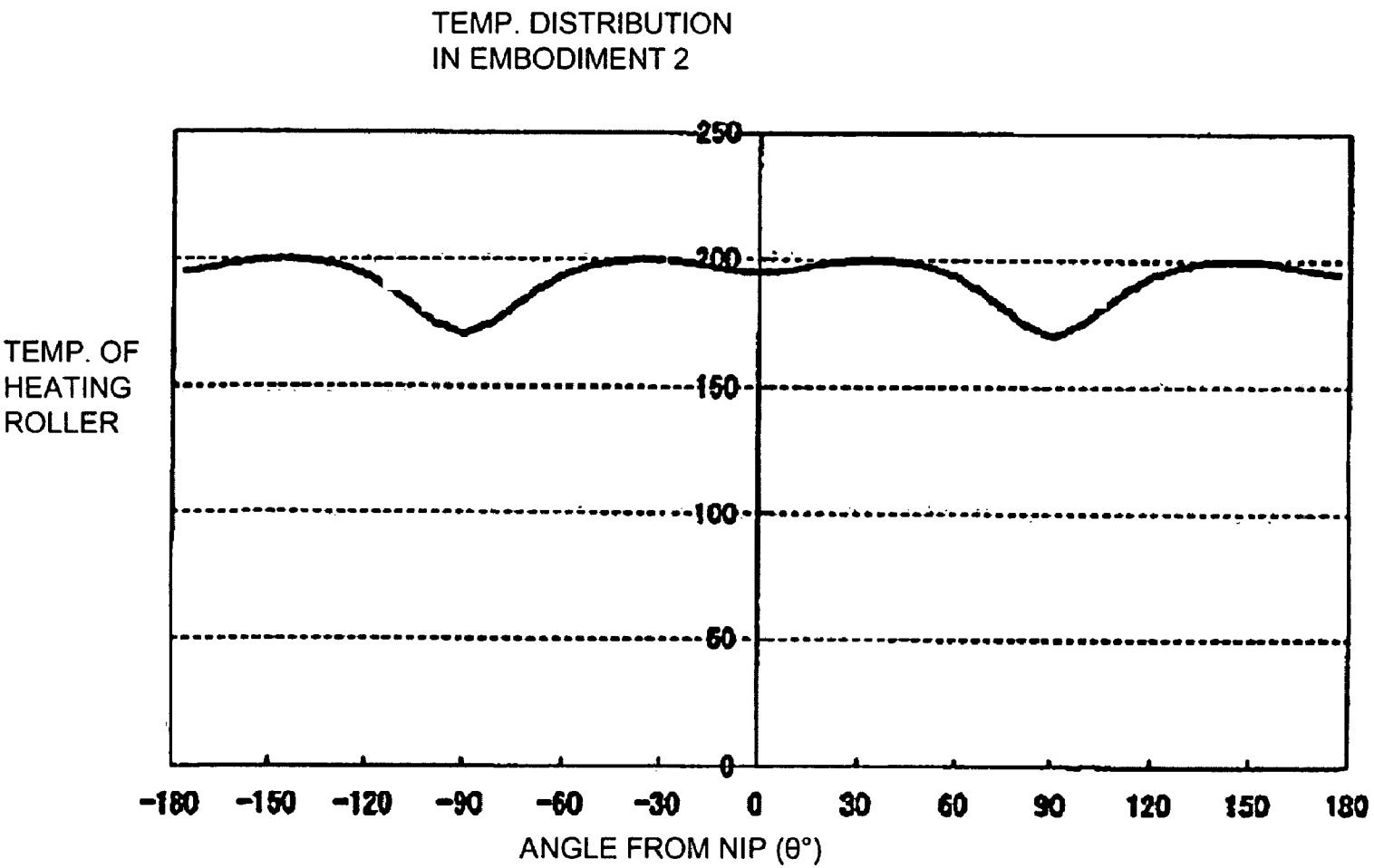
FIG. 12B is a graph which shows the temperature distribution of the heat roller in the second preferred embodiment, in terms of the circumferential direction of the roller.
Figure 13:
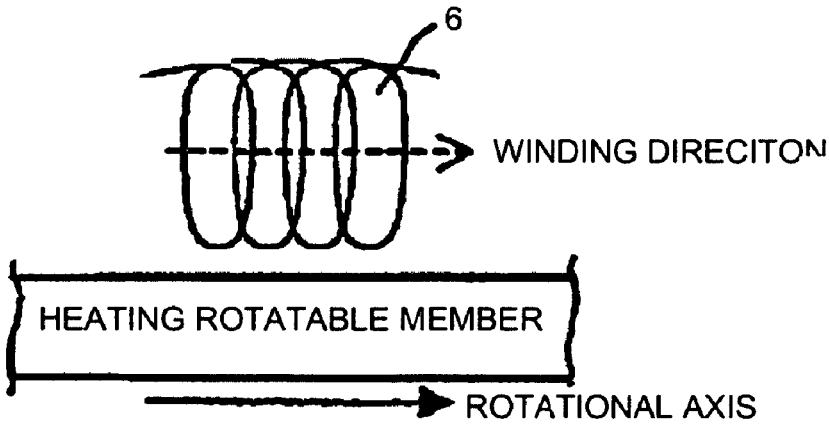
FIG. 13 is a schematic drawing which shows the attitudes in which the exciter coil is disposed.
Figure 13:
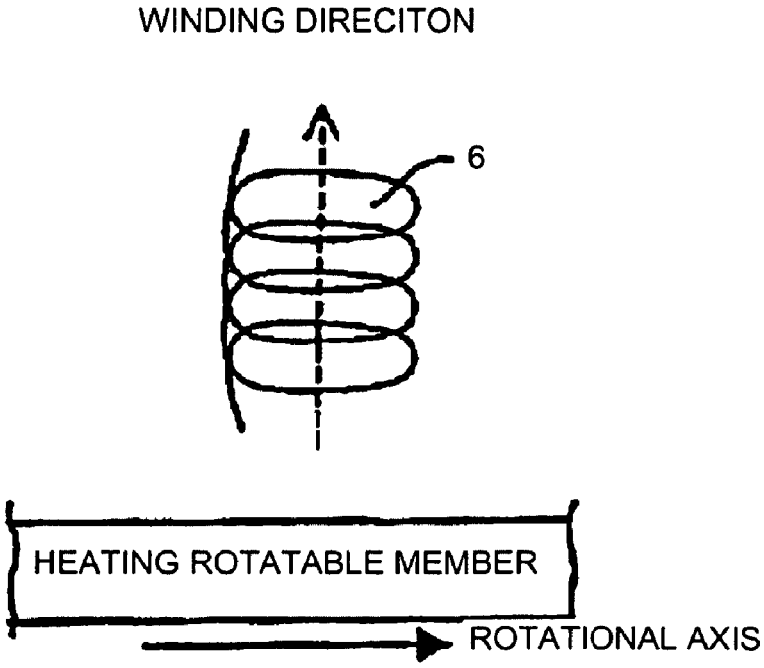

FIGS. 12A and 12B are graphs showing the heat generation amount distribution and temperature distribution, respectively, in terms of the circumferential direction of the heat roller 1 in the second preferred embodiment. The method used to obtain the two distributions is the same as that used in the first preferred embodiment described above.

Also in this embodiment, the thermistor 11 is disposed so that its position corresponds to the highest peak of the heat generation amount distribution in terms of the circumferential direction of the heat roller 1. The heat roller 1 is controlled in temperature so that its temperature measured at the point corresponding to the position of the thermistor 11 remains at a target temperature level (fixation temperature level T) of 200° C., which is lower than the Curie point Tc (210° C.) of the heat roller 1 (metallic core 1*a*). Therefore, the temperature of no point of the heat roller 1 in terms of the circumferential direction of the heat roller 1 will become higher than the Curie point Tc. Therefore, it does not occur that an excessive amount of current is flowed through the coils 6(1) and 6(2). Hence, it does not occur that the high frequency power source excessively increases in temperature, and/or breaks down.

In this embodiment, the thermistor 11 is disposed so that its position corresponds to the highest peak of the heat generation amount distribution of the heat roller 1. However, this embodiment is not intended to limit the present invention in terms of the positioning of the thermistor 11. For example, the thermistor 11 may be positioned 180° away from the fixation nip N. All that is necessary in such a case is to set the target temperature to a level (190° C., for example) that does not allow the temperature of the heat roller 1, which corresponds to the highest peak of the heat generation amount distribution, to exceed the Curie point (210° C.).

However, it is undesirable to dispose the thermistor 11 so that its position corresponds to the lowest point of the heat generation amount distribution of the heat roller 1. In this embodiment, or the second preferred embodiment, the amount of heat generation is smallest at 90° or −90°. In a case where the thermistor 11 is positioned in such a location (90° or −90°), current is flowed through the coils 6(1) and 6(2) by a relatively large amount immediately after the power source for the heating apparatus is turned on, compared to while the heating apparatus is kept on standby or recording sheets are conveyed. Thus, it is possible that in terms of the circumferential direction of the heat roller 1, the point of the heat roller 1, which corresponds in position to the highest point of the heat generation amount distribution of the heat roller 1, exceeds the Curie point Tc, across the entirety of the heat roller 1 in terms of the direction parallel to the axial line of the heat roller 1. This is why it is not desirable to dispose the thermistor 11 so that its position corresponds to the lowest point of the heat generation distribution of the heat roller 1. That is, in terms of the rotational direction of the heat roller 1, the heat roller 1 is not uniform in the amount of heat generation, and the thermistor 11 detects the temperature of the portion of the heat roller 1, which is not in the heat generation range, in which the amount by which heat is generated in the metallic core 1*a* is smallest.

As described above, also in this embodiment, the position for the thermistor 11 and the target temperature levels (fixation temperature level Tc, standby temperature level Ts) are selected so that in terms of both the direction parallel to the rotational axis of the heat roller 1 and the circumferential direction of the heat roller 1, the temperature of no point of the heat roller 1 will exceeds the Curie point Tc. Thus, it does not occur that current is flowed through the coils 6(1) and 6(2) by an excessive amount. Therefore, it does not occur that the high frequency power source excessively increases in temperature, and/or breaks down.

Further, this embodiment also may be variously modified, as may be the above described first embodiment, so that it becomes best suitable to the heating apparatus to which the present invention is applied. For example, there is a structural arrangement that continuously rotates the heat roller 1, or periodically rotates the heat roller 1 with preset intervals, at a low speed in a range of 50 mm/sec-100 mm/sec, which is slower than the heat roller 1 is rotated when heating images. Even in the case of this structural arrangement, by positioning the temperature detecting member as it is in this embodiment, it is possible to ensure that in terms of both the circumferential direction and the direction parallel to the rotational axis of the image heating member, the temperature of no point of the image heating member will become higher than the Curie point.

Further, this embodiment is not intended to limit the present invention in the positioning of the exciter coil. That is, even if the image heating apparatus is modified in the amount by which heat is generated by the upstream and downstream coils 6(1) and 6(2), and also, in the distribution of the amount of heat generation, the present invention is still applicable to the image heating apparatus.

As described above, according to the present invention, while an image heating apparatus is kept on standby, there is no portion of the image heating member, in terms of both the direction parallel to the rotational axis of the image heating apparatus and the circumferential direction of the image heating member, which is higher in temperature than the Curie point Tc, and therefore, current does not flow through the image heating member by an excessive amount. Therefore, it does not occur that the high frequency power source excessively increases in temperature, and/or breaks down.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 054611/2008 filed Mar. 5, 2008, which is hereby incorporated by reference.

What is claimed is:

1. An image heating apparatus for an image forming apparatus comprising:

a coil;

a rotatable image heating member for heating an image by heat generated by a magnetic flux generated by said coil;

a temperature detecting member for detecting a temperature of said image heating member;

electric power supply control means for controlling electric power supply to said coil in accordance with an output of said temperature detecting member;

an execution portion for executing a stand-by mode operation waiting for input of an image forming operation signal for forming an image on a recording material by the image forming apparatus; and a stand-by controller for controlling, in a state that rotation of said image heating member is not rotated during the stand-by mode operation, the electric power supply controlled by said electric power supply control means such that at least a temperature in a temperature detecting region by said temperature detecting member is a predetermined stand by temperature, wherein along no longitudinal line on said image heating member does the temperature of said image heating member exceed Curie temperature on an entirety of the longitudinal line, in a state that said stand-by controller controls the temperature in the temperature detecting region at the predetermined stand-by temperature.

2. An apparatus according to claim 1, wherein said coil is effective to heat substantially all peripheral surface of said image heating member.

3. An apparatus according to claim 1, wherein said temperature detecting member detects temperatures of a sheet passing area which is an area passed through by any of sheets which is usable with said apparatus.

4. An apparatus according to claim 1, wherein said image heating member has a heat generation distribution in a rotational direction, and said temperature detecting member detects a temperature of a portion where the heat generation is maximum in the distribution.

5. An apparatus according to claim 1, wherein said image heating member has a heat generation distribution in a rotational direction, and said temperature detecting member detects a temperature of a portion where the heat generation is minimum in the distribution.

6. An apparatus according to claim 1, wherein said apparatus comprises a plurality of such coils, and said electric power supply control means controls power supplies to said coils on the basis of an output of said temperature detecting member.

7. An image heating apparatus comprising:

a coil;

a rotatable image heating member capable of generating heat by a magnetic flux generated by said coil to heat an image;

a temperature detecting member for detecting a temperature of said image heating member;

electric power supply control means for controlling electric power supply to said coil in accordance with an output of said temperature detecting member; and an execution portion for executing a stand-by mode operation in which said image heating member is at rest, and said apparatus waits for input of an image formation signal while said electric power supply control means carries out its power supply control operation such that temperature of a part of said image heating member which is detected by said temperature detecting member is at a predetermined stand by temperature, wherein along no longitudinal line on said image heating member does the temperature of said image heating member exceed Curie temperature on an entirety of the longitudinal line, in the stand-by mode.

8. An apparatus according to claim 7, wherein said coil is effective to heat substantially all peripheral surface of said image heating member.

9. An apparatus according to claim 7, wherein said temperature detecting member detects temperatures of a sheet passing area which is an area passed through by any of sheets which is usable with said apparatus.

10. An apparatus according to claim 7, wherein said image heating member has a heat generation distribution in a rotational direction, and said temperature detecting member detects a temperature of a portion where the heat generation is maximum in the distribution.

11. An apparatus according to claim 7, wherein said image heating member has a heat generation distribution in a rotational direction, and said temperature detecting member detects a temperature of a portion where the heat generation is minimum in the distribution.

12. An apparatus according to claim 7, wherein said apparatus comprises a plurality of such coils, and said electric power supply control means controls power supplies to said coils on the basis of an output of said temperature detecting member.

13. An image heating apparatus comprising:

a coil;

a rotatable image heating member capable of generating heat by a magnetic flux generated by said coil to heat an image;

a temperature detecting member for detecting a temperature of said image heating member;

electric power supply control means for controlling electric power supply to said coil in accordance with an output of said temperature detecting member; and an execution portion for executing a stand-by mode operation in which said image heating member is at rest, and said apparatus waits for input of an image formation signal while said electric power supply control means carries out its power supply control operation such that temperature of a part of said image heating member which is detected by said temperature detecting member is at a predetermined stand-by temperature, wherein a position where said temperature detecting member detects the temperature of said image heating member is such that along no longitudinal line on said image heating member does the temperature of said image heating member exceed Curie temperature on an entirety of the longitudinal line, in the stand-by mode.

14. An apparatus according to claim 13, wherein said coil is effective to heat substantially all peripheral surface of said image heating member.

15. An apparatus according to claim 13, wherein said temperature detecting member detects temperatures of a sheet passing area which is an area passed through by any of sheets which is usable with said apparatus.

16. An apparatus according to claim 13, wherein said image heating member has a heat generation distribution in a rotational direction, and said temperature detecting member detects a temperature of a portion where the heat generation is maximum in the distribution.

17. An apparatus according to claim 13, wherein said image heating member has a heat generation distribution in a rotational direction, and said temperature detecting member detects a temperature of a portion where the heat generation is minimum in the distribution.

18. An apparatus according to claim 13, wherein said apparatus comprises a plurality of such coils, and said electric power supply control means controls power supplies to said coils on the basis of an output of said temperature detecting member.

19. An image heating apparatus comprising:

a coil;

a rotatable image heating member capable of generating heat by a magnetic flux generated by said coil to heat an image;

a temperature detecting member for detecting a temperature of said image heating member;

electric power supply control means for controlling electric power supply to said coil in accordance with an output of said temperature detecting member; and an execution portion for executing a stand-by mode operation in which said image heating member is at rest, and said apparatus waits for input of an image formation signal while said electric power supply control means carries out its power supply control operation such that temperature of a part of said image heating member which is detected by said temperature detecting member is at a predetermined stand-by temperature, wherein the predetermined stand-by temperature is determined such that along no longitudinal line on said image heating member does the temperature of said image heating member exceed Curie temperature on an entirety of the longitudinal line, in the stand-by mode.

20. An apparatus according to claim 19, wherein said coil is effective to heat substantially all peripheral surface of said image heating member.

21. An apparatus according to claim 19, wherein said temperature detecting member detects temperatures of a sheet passing area which is an area passed through by any of sheets which is usable with said apparatus.

22. An apparatus according to claim 19, wherein said image heating member has a heat generation distribution in a rotational direction, and said temperature detecting member detects a temperature of a portion where the heat generation is maximum in the distribution.

23. An apparatus according to claim 19, wherein said image heating member has a heat generation distribution in a rotational direction, and said temperature detecting member detects a temperature of a portion where the heat generation is minimum in the distribution.

24. An apparatus according to claim 19, wherein said apparatus comprises a plurality of such coils, and said electric power supply control means controls power supplies to said coils on the basis of an output of said temperature detecting member.

* * * * *